US011848168B2

(12) United States Patent
Gottschalk et al.

(10) Patent No.: US 11,848,168 B2
(45) Date of Patent: Dec. 19, 2023

(54) MULTI-LEVEL FEEDBACK ACTUATOR ASSEMBLY FOR A SOLID STATE CIRCUIT BREAKER

(71) Applicant: Eaton Intelligent Power Limited, Dublin (IE)

(72) Inventors: Andrew L. Gottschalk, Monaca, PA (US); Robert Michael Slepian, Murrysville, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 126 days.

(21) Appl. No.: 17/534,826

(22) Filed: Nov. 24, 2021

(65) Prior Publication Data

US 2022/0084768 A1 Mar. 17, 2022

Related U.S. Application Data

(63) Continuation of application No. 16/502,143, filed on Jul. 3, 2019, now Pat. No. 11,211,219.

(51) Int. Cl.
*H01H 75/00* (2006.01)
*H01H 71/10* (2006.01)
(Continued)

(52) U.S. Cl.
CPC ..... *H01H 71/10* (2013.01); *H01H 1/06* (2013.01); *H01H 71/02* (2013.01); *H01H 2215/05* (2013.01)

(58) Field of Classification Search
CPC ..... H01H 71/10; H01H 1/06; H01H 71/02; H01H 2215/05; H01H 9/548; H01H 71/24; H01H 71/2472; H01H 71/04
(Continued)

(56) References Cited

U.S. PATENT DOCUMENTS 4,639,700 A * 1/1987 Shestak ..... H01H 71/1054 335/157
7,064,634 B1 * 6/2006 Wehrli, III ..... H01H 71/1054 335/157

(Continued)

OTHER PUBLICATIONS

European Patent Office "International Preliminary Report on Patentability and Written Opinion", from corresponding International Application No. PCT/EP20/025307, published as WO 2021/001057, dated Dec. 28, 21, 10 pp.

*Primary Examiner* — Shawki S Ismail
*Assistant Examiner* — Lisa N Homza
(74) *Attorney, Agent, or Firm* — Eckert Seamans Cherin & Mellott, LLC

(57) ABSTRACT

A multi-level feedback actuator assembly for a circuit breaker assembly includes a rotary solenoid, an electric actuator assembly and a manual actuator assembly. The electric actuator assembly includes a switch assembly with an actuator. The manual actuator assembly includes a number of primary actuators, a linkage assembly, and a cam assembly. The number of primary actuators includes a first actuator with a body. The first actuator body is structured to move over a path having at least a first portion and a second portion. The rotary solenoid is operatively coupled to the linkage assembly. The linkage assembly is further operatively coupled to an operating mechanism crossbar. In this configuration, the linkage assembly is structured to apply at least a first bias and a second bias to the first actuator body. Further, the first bias is noticeably different from said second bias.

20 Claims, 14 Drawing Sheets

(51) Int. Cl.
*H01H 1/06* (2006.01)
*H01H 71/02* (2006.01)

(58) Field of Classification Search
USPC ..... 335/6
See application file for complete search history.

(56) References Cited

U.S. PATENT DOCUMENTS

| | | | | |
|---|---|---|---|---|
| 2008/0245645 | A1* | 10/2008 | Dolinski | H01H 3/30 200/401 |
| 2015/0170849 | A1* | 6/2015 | Milholland | H01H 9/24 200/50.28 |
| 2016/0035526 | A1* | 2/2016 | Mittlestadt | H01H 71/0264 200/50.02 |
| 2017/0256934 | A1 | 9/2017 | Kennedy et al. | |
| 2019/0198267 | A1 | 6/2019 | Zhou et al. | |
| 2021/0005413 | A1* | 1/2021 | Gottschalk | H01H 50/02 |

* cited by examiner

MULTI-LEVEL FEEDBACK ACTUATOR ASSEMBLY FOR A SOLID STATE CIRCUIT BREAKER

CROSS REFERENCE TO RELATED APPLICATION

This application is a continuation application of and claims priority to U.S. patent application Ser. No. 16/502,143, filed Jul. 3, 2019, the disclosures of which are incorporated herein by reference.

BACKGROUND OF THE INVENTION

Field of the Invention

The disclosed and claimed concept relates to a circuit breaker and, more specifically, to a circuit breaker operating mechanism including a multi-level feedback actuator assembly.

Background Information

Circuit breakers are used to protect electrical circuitry from damage due to an over-current condition, such as an overload condition or a relatively high level short circuit or fault condition. That is, a circuit breaker is typically disposed between a line, i.e., a source of electricity, and a load, i.e., a device or construct that uses electricity. Mechanical circuit breakers typically include a number of pairs of separable contacts, an operating mechanism, and a trip unit. Each pair of separable contacts is coupled to, and in electrical communication with, either the line or the load. The separable contacts, typically, include a movable contact and a fixed/stationary contact. It is understood that a circuit breaker includes one or more pairs of separable contacts. Hereinafter, however, a single pair of separable contacts is discussed.

The movable contact moves between an open, first position and a closed, second position. When the movable contact is in the first position, the separable contacts are not in electrical communication and no current passes through the circuit breaker. When the movable contact is in the second position, the separable contacts are in electrical communication and current passes through the circuit breaker. The separable contacts may be operated either manually by way of an actuator disposed on the outside of the housing assembly or automatically in response to an over-current condition. That is, the trip unit is structured to detect over-current conditions. When an over-current condition is detected, the trip unit actuates the operating mechanism thereby rapidly moving the movable contacts to an open configuration. The operating mechanism is further structured to move the movable contacts from the open, first position to the closed, second position and thereafter maintain the contacts in the closed, second position. One problem with mechanical circuit breakers is that the separation of the separable contacts, i.e., interruption of the current, is slower than is often desirable.

Solid state circuit breakers interrupt a current at a greater speed. Solid state circuit breakers utilize solid state components to interrupt the current and separable contacts for galvanic isolation. That is, the solid state components interrupt the current and the separable contacts separate to prevent any trace currents or (electrical) leakage that the solid state components fail to interrupt. A solid state circuit breaker includes, but is not limited to, a solid state switching circuit having solid state switching elements (e.g., without limitation, insulated-gate bipolar transistors (IGBTs)) that are structured to switch between on and off configurations (i.e., close and open configurations), a trip unit circuit, and an electric actuator assembly for the separable contacts. Upon the trip unit circuit detecting an impending fault or exceedingly high and unacceptable overvoltage condition in the circuit breaker, the trip unit circuit generates a signal that quickly switches the solid state switching elements to the off/open configuration. Thus, the trip unit circuit functions as an operating mechanism for the solid state switching elements. Hereinafter, the term "trip unit circuit" will be used for this component so as to distinguish it from the "operating mechanism" that is associated with the separable contacts. Meanwhile, the electric actuator assembly generates a disconnect command for the separable contacts, thereby moving the separable contacts to the open, first position. Together, the switched "off" solid-state device and open separable contacts protect the load and associated load circuit from being damaged and electrically and physically isolate the source of the fault or overload condition from the remainder of the electrical power distribution system.

Further, some solid state circuit breakers include an indicator, sometimes identified as a "flag," that is mechanically linked to the separable contacts. That is, the flag has a visual representation, e.g., a red portion and a green portion, or, the words "open" and "closed." The flag appears in a window in the circuit breaker housing. Thus, for example, when the separable contacts are in the first position, the flag displays the word "open." As the flag is mechanically linked to the separable contacts, and barring a breakdown in the mechanical linkage, the flag always displays the state of the contacts. The flag does not, however, display whether the solid state switching elements have "closed." Thus, some solid state circuit breakers also include an indicator such as, but not limited to, a light that is coupled to the solid state switching elements. That is, for example, when the solid state switching elements are in the on/closed configuration, the indicator light is illuminated.

One advantage of employing the solid-state device is that impending faults can be reacted to in a matter of microseconds. That is, the solid-state device interrupts the current prior to the contacts separating. Thus, when the separable contacts move to the first position after the solid-state device is in the off/open configuration, the chance of an arc forming between the separable contacts is minimized.

Closing the solid state circuit breaker is accomplished by the trip unit circuit which, as noted above, acts as an operating mechanism for the solid state switching elements. That is, closing the solid state circuit breaker requires energy, typically energy drawn from the line. That is, the trip unit circuit and/or the solid state switching elements need power to switch between the on and off configurations. The power is, typically drawn from the line. To draw power from the line, however, requires a current to pass through the solid state circuit breaker. That is, the movable contact has to be in the second position, i.e., the separable contacts need to be closed, and there must be power in the line. For the movable contact to move to the second position, the operating mechanism must be powered.

For example, one type of operating mechanism for solid state circuit breaker separable contacts utilizes a rotary solenoid(s) to move the movable contacts between the first and second positions. While two rotary solenoids may be used (a first rotary solenoid to move the movable contacts from the first position to the second position, and, a second rotary solenoid to move the movable contacts from the second position to the first position), in an exemplary embodiment a single rotary solenoid is bi-directional and moves the movable contacts between the first and second positions.

In an exemplary embodiment, the bi-directional rotary solenoid is actuated by an electric actuator assembly. That is, the electric actuator assembly includes an external actuator, e.g., a button, and a switch assembly that holds a charge, e.g., a switch assembly with a capacitor or that is in electrical communication with the capacitors noted above. When the external actuator is actuated by a user, the switch assembly releases the charge which actuates the bi-directional rotary solenoid causing the operating mechanism to move the movable contact between the first and second positions. Typically, the degree by which the actuator/button needs to be pushed so as to actuate the operating mechanism is slight, i.e., a small motion that requires little force.

Further, because the bi-directional rotary solenoid is not separating contacts with energy passing therethrough, the bi-directional rotary solenoid, typically, operates at a slower speed than a bi-directional rotary solenoid separating contacts with energy passing therethrough. Generally, a slower moving rotary solenoid operates more quietly than a faster rotary solenoid. Moreover, the moving elements of the rotary solenoid are disposed within a rotary solenoid housing which, in turn, is disposed within the circuit breaker housing. Thus, the operation of the rotary solenoid is difficult for a user to detect.

With the solid state circuit breaker in this configuration, there are different scenarios that could occur following an overcurrent event. For example:

1) There is no power on the line side of the solid state circuit breaker, there is no charge in the switch assembly capacitors and the flag indicates that the movable contact is in the first position open, i.e., the separable contacts are open. A user looking at the solid state circuit breaker does not know the line side power is off or that the capacitors have no power, they only know that the separable contacts are open. If the user assumes that the line is energized, they attempt to close the separable contacts and they push the button a short distance with a light force to hit the switch and nothing happens. That is, without energy from the switch assembly capacitors, there is no energy to cause the operating mechanism to move the movable contact to the second position. In this situation, the flag does not indicate that the separable contacts are closed. Further, if the separable contacts are not closed, the trip unit circuit cannot change the solid state switching elements to the on/closed configuration.

2) There is power on the line side of the solid state circuit breaker but no charge in/to the capacitors and the flag states the breaker is open. A user looks at the breaker and does not know the line side power is on or that the capacitors have no power, they only know that the separable contacts are open. They attempt to close the breaker and they push the actuator/button a short distance with a light force and nothing happens. Again, the flag does not indicate that the separable contacts are closed.

3) The line side of the solid state circuit breaker has no power but the capacitors still have a charge. The user presses the close button a short distance and with light force; this causes the capacitors to actuate the solenoid and the separable contacts close. There is, however, no power from the line to allow the trip unit to switch the configuration of the solid state switching elements from the off/open configuration to the on/closed configuration. The flag (which is mechanically coupled to the separable contacts) indicates the solid state circuit breaker is closed but, the trip unit circuit cannot change the solid state switching elements to the on/closed configuration as there is no power from the line.

4) There is power to the line side of the solid state circuit breaker and the capacitors are charged. The user presses the close button a short distance and with light force. This causes the capacitors to actuate the solenoid and the separable contacts close, the trip unit powers up and the semiconductors connect line to load power. This is the expected operation of the solid state circuit breaker.

There are several problems associated with an operating mechanism with a bi-directional rotary solenoid as described above. First, as noted, the switch assembly capacitors may not have a charge when the user presses the external actuator. Without a switch assembly capacitor charge, the bi-directional rotary solenoid cannot be actuated electronically. Further, the external actuator, which is the interface between the user and the operating mechanism, does not provide feedback to the user indicating the status of the switch assembly and/or the bi-directional rotary solenoid. That is, when the user actuates the external actuator there is no feedback that indicates that the switch assembly and/or the bi-directional rotary solenoid have operated as described above. This is a problem.

Further, in some embodiments the operating mechanism includes a manual actuator assembly in addition to the electric switch assembly. The actuator/switch assemblies utilize the same external actuator (button). The external actuator, however, does not provide feedback that indicates to the user whether the electric actuator assembly has been actuated and/or that the manual actuator assembly needs to be actuated. That is, as noted above, the operation of the rotary solenoid is muffled by multiple housings. Thus, in a situation wherein the switch assembly does not have a charge, a user may actuate an external actuator and believe that the electric actuator assembly has operated. Such a user would not attempt to utilize the manual actuator assembly. Alternatively, in a situation wherein the switch assembly has a charge, a user may actuate an external actuator and believe that the electric actuator assembly has not operated. Thus, the user would attempt to utilize the manual actuator assembly after the movable contacts have already moved between the first and second positions. This is a problem.

Further, some circuit breaker assemblies include an under voltage regulation assembly structured to move the movable contacts from the second position to the first position when the voltage dropped below a selected limit. The under voltage regulation assembly was a separate assembly, i.e., the under voltage regulation assembly was not part of the operating mechanism. Thus, adding an under voltage regulation assembly increased the cost of a circuit breaker. This is a problem.

Further, users are known to prefer symmetry regarding characteristics of a circuit breaker and/or an operating mechanism. That is, for example, if a circuit breaker/operating mechanism includes two separate user interfaces, e.g., buttons, a user expects/prefers that the tactile feedback from the buttons is generally similar. That is, if one button is easy to press and the other button is hard to press, a user will assume that one of the buttons in not operating properly. Thus, actuator assemblies that perform similar, or complimentary, actions are expected to provide a similar tactile feedback. For example, the actuator assemblies that open and close the contacts of a circuit breaker assembly are expected to provide a similar tactile feedback. If such actuator assemblies provide a different tactile feedback, it is a problem.

There is, therefore a need for a multi-level feedback actuator assembly for a circuit breaker assembly that is structured to provide noticeably different feedback to a user wherein the noticeably different feedback informs the user if the operating mechanism is, or has, moved the movable contacts from the first position to the second position utilizing an electric actuator assembly, or, that the electric actuator assembly has failed to move the movable contacts from the first position to the second position and that the user must utilize a manual actuator assembly to move the movable contacts from the first position to the second position. There is a further need for the multi-level feedback actuator assembly to provide an indication to the user that the movable contacts have moved from the first position to the second position. There is a further need for an under voltage regulation assembly that is incorporated into the operating mechanism. There is a further need for a multi-level feedback actuator assembly that provides generally the same tactile feedback for both the open actuator and close actuator.

SUMMARY OF THE INVENTION

These needs, and others, are met by at least one embodiment of this invention which provides a multi-level feedback actuator assembly for a circuit breaker assembly including a rotary solenoid including a rotating output shaft, an electric actuator assembly and a manual actuator assembly. The electric actuator assembly includes a switch assembly with an actuator. The switch assembly is operatively coupled to said rotary solenoid and is structured to actuate said rotary solenoid. The manual actuator assembly includes a number of primary actuators, a linkage assembly, and a cam assembly. The number of primary actuators includes a first actuator with a body. The first actuator body is structured to move over a path having at least a first portion and a second portion. The rotary solenoid is operatively coupled to the linkage assembly. The linkage assembly is operatively coupled to the rotary solenoid and to the first actuator body. The linkage assembly is further structured to be operatively coupled to an operating mechanism crossbar. In this configuration, the linkage assembly is structured to apply at least a first bias and a second bias to the first actuator body. Further, the first bias is noticeably different from said second bias. Thus, the linkage assembly is structured to apply said first bias to said first actuator body when said first actuator body is disposed in said first actuator body path first portion, and, to apply said second bias to said first actuator body when said first actuator body is disposed in said first actuator body path second portion.

It is understood that the first actuator is structured to, and does, actuate the electric actuator assembly as it moves over the first actuator body path first portion and the manual actuator assembly as it moves over the first actuator body path second portion. Further, as the bias applied to the first actuator body, i.e., the feedback bias felt by the user, is noticeably different as the first actuator body moves between the first actuator body path first portion and the first actuator body path second portion, the user is informed as to which actuator assembly is being utilized.

That is, when a user actuates the first actuator, the bias applied to the first actuator is further transferred/transmitted to the user. That is, the user feels the bias on the first actuator body. In an exemplary embodiment, the user has been informed, e.g., in a user manual, that the noticeably different biases indicate that different actuating assemblies are being actuated. For example, the user is informed that a light bias indicates that the electric actuator assembly is being actuated whereas a stronger bias indicates that the manual actuator assembly is being actuated. Thus, as the user initially actuates the first actuator, the first actuator moves over the first actuator body path first portion and the first bias is transferred/transmitted to the user via the first actuator. During this motion, the user feels a light bias and is informed via this tactile feedback that the first actuator is actuating the electric actuator assembly. If the electric actuator assembly in non-operative, the user does not receive an indication that the movable contact has moved between positions. For example, the flag does not change positions. Thus, the user is informed that further action is required to change the position of the movable contact. Accordingly, the user continues to press on the first actuator causing the first actuator to move into, and over, the first actuator body path second portion. As the first actuator moves into, and over, the first actuator body path second portion, the second bias is applied to the first actuator and this stronger bias is felt by the user. Thus, the user is informed that the first actuator is actuating the manual actuator assembly.

Further, the elements of the multi-level feedback actuator assembly, which is part of the operating mechanism, are also structured to be an under voltage regulation assembly. A multi-level feedback actuator assembly in such a configuration, as described in detail below, solves the problems stated above.

BRIEF DESCRIPTION OF THE DRAWINGS

A full understanding of the invention can be gained from the following description of the preferred embodiments when read in conjunction with the accompanying drawings in which:

FIGS. 4A and 4B are the same and are provided for clarity with respect to the reference numbers.

FIGS. 6-10 sequentially show the positions of the identified elements, as well as a line of force, as the multi-level feedback closing actuator assembly is actuated.

FIGS. 12-14 sequentially show the positions of the identified elements, as well as a line of force, as the multi-level feedback opening actuator assembly is actuated.

DESCRIPTION OF THE PREFERRED EMBODIMENTS

Figure 1:
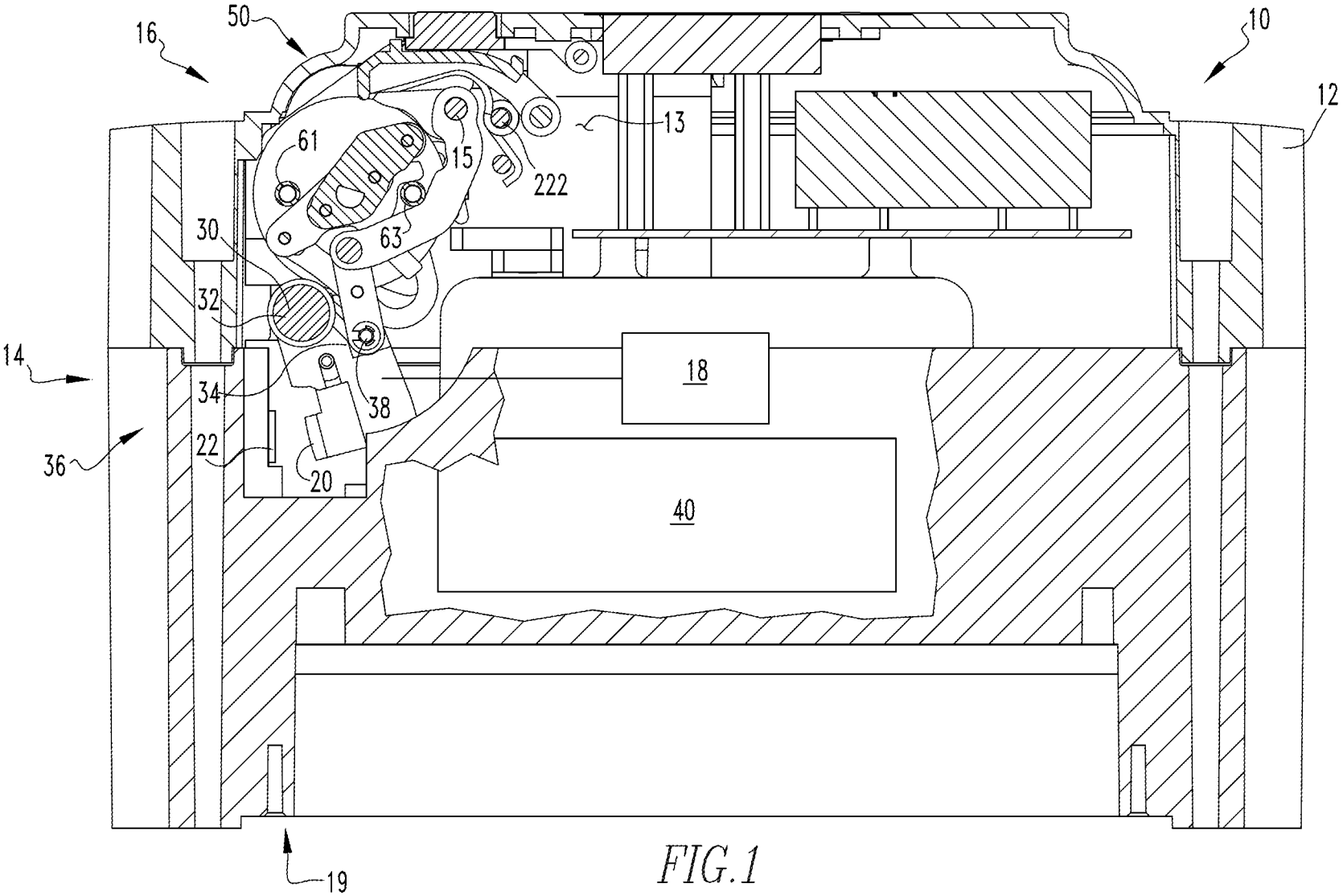
FIG. 1 is a partially schematic, partial cross-sectional side view of a circuit breaker assembly.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function. Further, as used herein, "structured to [verb]" means that the identified element or assembly is intended to, and is designed to, perform the identified verb. Thus, an element that is merely capable of performing the identified verb but which is not intended to, and is not designed to, perform the identified verb is not "structured to [verb]."

As used herein, "associated" means that the elements are part of the same assembly and/or operate together, or, act upon/with each other in some manner. For example, an automobile has four tires and four hubcaps. While all the elements are coupled as part of the automobile, it is understood that each hubcap is "associated" with a specific tire.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut or threaded bore.

As used herein, a "rotational coupling" means a coupling that rotatably coupled two or more elements. A "rotational coupling" includes, but is not limited to, openings (or similar constructs) in elements through which a pin, axle, or similar construct is, or can be, inserted. That is, a "rotational coupling" includes an opening on different elements, i.e., at least two openings or similar constructs, as well as a pin, axle, or similar construct, or, an opening on one element and a pin, axle, or similar construct on another element. Thus, as used herein, an "opening" that is described as a "rotational coupling" is also properly identified as a "coupling" or "rotational coupling." Further, in an instance wherein the following description fails to mention or identify a pin, axle or similar construct that is associated with a "rotational coupling," it is understood that such a pin, axle or similar construct exists and that such a pin, axle or similar construct extends through the openings identified as a "rotational coupling." Further, as used herein, all elements that are described as being "rotatably coupled" have a "rotational coupling" as defined herein.

As used herein, a "fastener" is a separate component structured to couple two or more elements. Thus, for example, a bolt is a "fastener" but a tongue-and-groove coupling is not a "fastener." That is, the tongue-and-groove elements are part of the elements being coupled and are not a separate component.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other.

Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof. Further, an object resting on another object held in place only by gravity is not "coupled" to the lower object unless the upper object is otherwise maintained substantially in place. That is, for example, a book on a table is not coupled thereto, but a book glued to a table is coupled thereto.

As used herein, the phrase "removably coupled" or "temporarily coupled" means that one component is coupled with another component in an essentially temporary manner. That is, the two components are coupled in such a way that the joining or separation of the components is easy and would not damage the components. For example, two components secured to each other with a limited number of readily accessible fasteners, i.e., fasteners that are not difficult to access, are "removably coupled" whereas two components that are welded together or joined by difficult to access fasteners are not "removably coupled." A "difficult to access fastener" is one that requires the removal of one or more other components prior to accessing the fastener wherein the "other component" is not an access device such as, but not limited to, a door.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true. With regard to electronic devices, a first electronic device is "operatively coupled" to a second electronic device when the first electronic device is structured to, and does, send a signal or current to the second electronic device causing the second electronic device to actuate or otherwise become powered or active.

As used herein, "temporarily disposed" means that a first element(s) or assembly (ies) is resting on a second element (s) or assembly(ies) in a manner that allows the first element/assembly to be moved without having to decouple or otherwise manipulate the first element. For example, a book simply resting on a table, i.e., the book is not glued or fastened to the table, is "temporarily disposed" on the table.

As used herein, the statement that two or more parts or components "engage" one another means that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A engages element B while in element A first position.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "temporarily coupled" to the screw. If an axial force is applied to the screwdriver, the screwdriver is pressed against the screw and "engages" the screw. However, when a rotational force is applied to the screwdriver, the screwdriver "operatively engages" the screw and causes the screw to rotate. Further, with electronic components, "operatively engage" means that one component controls, e.g., actuates, another component by a control signal or current.

As used herein, in the phrase "[x] moves between its first position and second position," or, "[y] is structured to move [x] between its first position and second position," "[x]" is the name of an element or assembly. Further, when [x] is an element or assembly that moves between a number of positions, the pronoun "its" means "[x]," i.e., the named element or assembly that precedes the pronoun "its."

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening are made from a deformable or compressible material, the opening may even be slightly smaller than the component being inserted into the opening. With regard to surfaces, shapes, and lines, two, or more, "corresponding" surfaces, shapes, or lines have generally the same size, shape, and contours. With regard to elements/assemblies that are movable or configurable, "corresponding" means that when elements/assemblies are related and that as one element/assembly is moved/reconfigured, then the other element/assembly is also moved/reconfigured in a predetermined manner. For example, a lever including a central fulcrum and elongated board, i.e., a "see-saw" or "teeter-totter," the board has a first end and a second end. When the board first end is in a raised position, the board second end is in a lowered position. When the board first end is moved to a lowered position, the board second end moves to a "corresponding" raised position. Alternately, a cam shaft in an engine has a first lobe operatively coupled to a first piston. When the first lobe moves to its upward position, the first piston moves to a "corresponding" upper position, and, when the first lobe moves to a lower position, the first piston, moves to a "corresponding" lower position.

As used herein, a "path of travel" or "path," when used in association with an element that moves, includes the space an element moves through when in motion. As such, and as used herein, any element that moves inherently has a "path of travel" or "path." Further, a "path of travel" or "path" relates to a motion of one identifiable construct as a whole relative to another object. For example, assuming a perfectly smooth road, a rotating wheel (an identifiable construct) on an automobile generally does not move relative to the body (another object) of the automobile. That is, the wheel, as a whole, does not change its position relative to, for example, the adjacent fender. Thus, a rotating wheel does not have a "path of travel" or "path" relative to the body of the automobile. Conversely, the air inlet valve on that wheel (an identifiable construct) does have a "path of travel" or "path" relative to the body of the automobile. That is, while the wheel rotates and is in motion, the air inlet valve, as a whole, moves relative to the body of the automobile.

As used herein, a "planar body" or "planar member" is a generally thin element including opposed, wide, generally parallel surfaces, i.e., the planar surfaces of the planar member, as well as a thinner edge surface extending between the wide parallel surfaces. That is, as used herein, it is inherent that a "planar" element has two opposed planar surfaces with an edge surface extending therebetween. The perimeter, and therefore the edge surface, may include generally straight portions, e.g., as on a rectangular planar member such as on a credit card, or be curved, as on a disk such as on a coin, or have any other shape.

As used herein, the word "unitary" means a component that is created as a single piece or unit. That is, a component that includes pieces that are created separately and then coupled together as a unit is not a "unitary" component or body.

As used herein, "unified" means that all the elements of an assembly are disposed in a single location and/or within a single housing, frame or similar construct.

As used herein, the term "number" shall mean one or an integer greater than one (i.e., a plurality). That is, for example, the phrase "a number of elements" means one element or a plurality of elements. It is specifically noted that the term "a 'number' of [X]" includes a single [X].

As used herein, a "radial side/surface" for a circular or cylindrical body is a side/surface that extends about, or encircles, the center thereof or a height line passing through the center thereof. As used herein, an "axial side/surface" for a circular or cylindrical body is a side that extends in a plane extending generally perpendicular to a height line passing through the center. That is, generally, for a cylindrical soup can, the "radial side/surface" is the generally circular sidewall and the "axial side(s)/surface(s)" are the top and bottom of the soup can. Further, as used herein, "radially extending" means extending in a radial direction or along a radial line. That is, for example, a "radially extending" line extends from the center of the circle or cylinder toward the radial side/surface. Further, as used herein, "axially extending" means extending in the axial direction or along an axial line. That is, for example, an "axially extending" line extends from the bottom of a cylinder toward the top of the cylinder and substantially parallel to, or along, a central longitudinal axis of the cylinder.

As used herein, "generally curvilinear" includes elements having multiple curved portions, combinations of curved portions and planar portions, and a plurality of linear/planar portions or segments disposed at angles relative to each other thereby forming a curve.

As used herein, an "elongated" element inherently includes a longitudinal axis and/or longitudinal line extending in the direction of the elongation.

As used herein, "about" in a phrase such as "disposed about [an element, point or axis]" or "extend about [an element, point or axis]" or "[X] degrees about an [an element, point or axis]," means encircle, extend around, or measured around. When used in reference to a measurement or in a similar manner, "about" means "approximately," i.e., in an approximate range relevant to the measurement as would be understood by one of ordinary skill in the art.

As used herein, "generally" means "in a general manner" relevant to the term being modified as would be understood by one of ordinary skill in the art.

As used herein, "substantially" means "by a large amount or degree" relevant to the term being modified as would be understood by one of ordinary skill in the art.

As used herein, "at" means on and/or near relevant to the term being modified as would be understood by one of ordinary skill in the art.

As used herein, "in electronic communication" is used in reference to communicating a signal via an electromagnetic wave or signal. "In electronic communication" includes both hardline and wireless forms of communication; thus, for example, a "data transfer" or "communication method" via a component "in electronic communication" with another component means that data is transferred from one computer to another computer (or from one processing assembly to another processing assembly) by physical connections such as USB, Ethernet connections or remotely such as NFC, blue tooth, etc. and should not be limited to any specific device.

As used herein, "in electric communication" means that a current passes, or can pass, between the identified elements. Being "in electric communication" is further dependent upon an element's position or configuration. For example, in a circuit breaker, a movable contact is "in electric communication" with the fixed contact when the contacts are in a closed position. The same movable contact is not "in electric communication" with the fixed contact when the contacts are in the open position.

As used herein, "noticeably different," when used in relation to comparing two or more biases (including counter/feedback forces), means that the bias is detectable to a human. That is, a "noticeably different" bias relative to biases less than 1.0 lbf, or wherein one of the biases is less than 1.0 lbf, means that the difference between the biases is more than 25%. Further, a "noticeably different" bias relative to biases wherein both biases are greater than 1.0 lbf means that the difference between the biases is at least 1.0 lbf.

As used herein, a "noticeable feedback" when used in relation to a solenoid means that the solenoid is structured to generate a sound and/or a vibration that is detectable by a human. That is, certain solenoids are structured to reduce sound and/or a vibration and do not generates a "noticeable feedback" as used herein. For example, a solenoid that includes a dampener and/or a muffler such as, but not limited to, a housing that is disposed within another housing does not generate a "noticeable feedback" as used herein. In addition to other configurations not specifically identified, a solenoid that includes stop pins external to the housing and which are impacted by elements moved by the solenoid are structured to, and do, provide "noticeable feedback" as used herein.

As used herein, a "use current" is the current that a circuit breaker assembly is structured to pass therethrough when the circuit breaker assembly contacts are in the closed position.

As used herein, and when used in association with a solenoid that draws a current from the use current passing through a circuit breaker, a "proportional current" means that the current drawn by the solenoid is a fixed proportion of the use current. For example, a current drawn by the solenoid which fluctuates with the use current, but which is always a set percentage of the use current, is a "proportional current."

As used herein, a "multi-level feedback" actuator means an actuator that moves over a path and that is structured to, and does, provide a tactile feedback to a user. As used herein, a "tactile feedback" means a bias that is transmitted to the user via the actuator that the user has actuated. Further, to be a "multi-level feedback" actuator, as used herein, the tactile feedback is noticeably different as the actuator moves over/through different portions of the actuator's path of travel.

A solid state circuit breaker assembly 10 (hereinafter, and as used herein, a "circuit breaker assembly" 10) is shown in FIG. 1 (some elements shown schematically). The circuit breaker assembly 10 includes a housing assembly 12, a conductor assembly 14, an operating mechanism 16, a trip assembly 18 and a solid state interrupter assembly 40. The circuit breaker assembly housing assembly 12 defines an enclosed space 13 in which most other elements of the circuit breaker assembly 10 are disposed or are substantially disposed. In an exemplary embodiment, the circuit breaker assembly housing assembly 12 is elongated. In an exemplary embodiment, the circuit breaker assembly housing assembly 12 includes an elongated, generally circular axle 15 that is structured to be, and is, a rotational mounting for selected elements, as discussed below. The circuit breaker assembly housing assembly axle 15, in an exemplary embodiment, extends generally laterally relative to the circuit breaker assembly housing assembly 12 longitudinal axis.

The solid state interrupter assembly 40, shown schematically, includes, a solid state switching circuit having solid state switching elements (e.g., without limitation, insulated-gate bipolar transistors (IGBTs)) that are structured to switch between on and off configurations (i.e., close and open configurations) and a trip unit circuit (none numbered) which operates as discussed above. It is understood that the solid state interrupter assembly 40 is coupled to, and is in selective communication with, the conductor assembly 14 and a line and load (not shown). In an exemplary embodiment, the trip unit circuit includes, is included within, or is operatively coupled to, the trip assembly 18. That is, when the trip unit circuit is actuated, so is the trip assembly 18. As noted above, the trip unit circuit is, effectively, the operating mechanism for the solid state interrupter assembly 40 and the "operating mechanism 16" identified above is associated with the contact assembly 19, discussed below.

The conductor assembly 14 includes a number of elongated conductive members (not numbered) which are in electrical communication with a line and a load, not shown. In an exemplary embodiment, any "conductive" element is made from a conductive metal such as, but not limited to, copper, aluminum, gold, silver, or platinum. The conductor assembly 14 further includes a contact assembly 19 having a number of movable contacts 20 and a corresponding number of fixed contacts 22 (one each shown). Hereinafter, this description will address a single pair of contacts 20, 22; it is, however, understood that, in an exemplary embodiment, the circuit breaker assembly 10 includes multiple pairs of contacts 20, 22.

Figure 9:
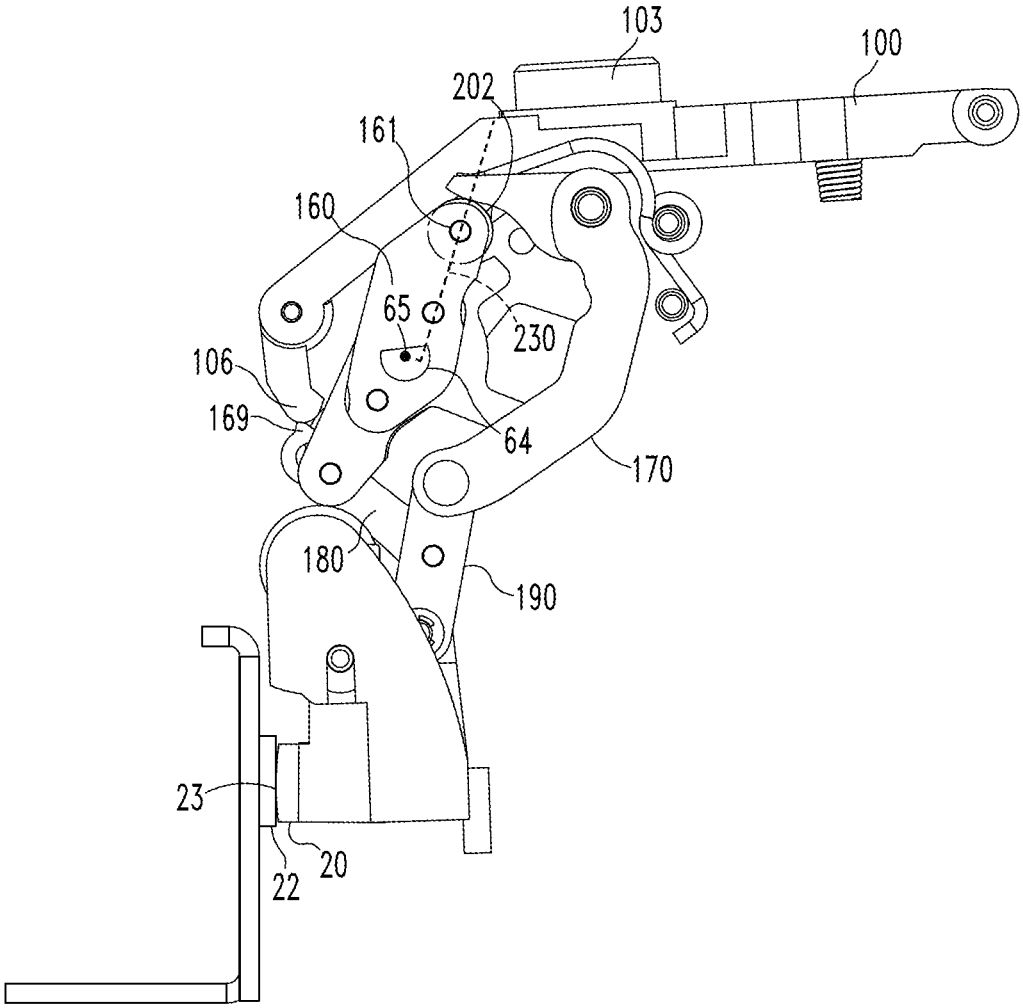
Figure 10:
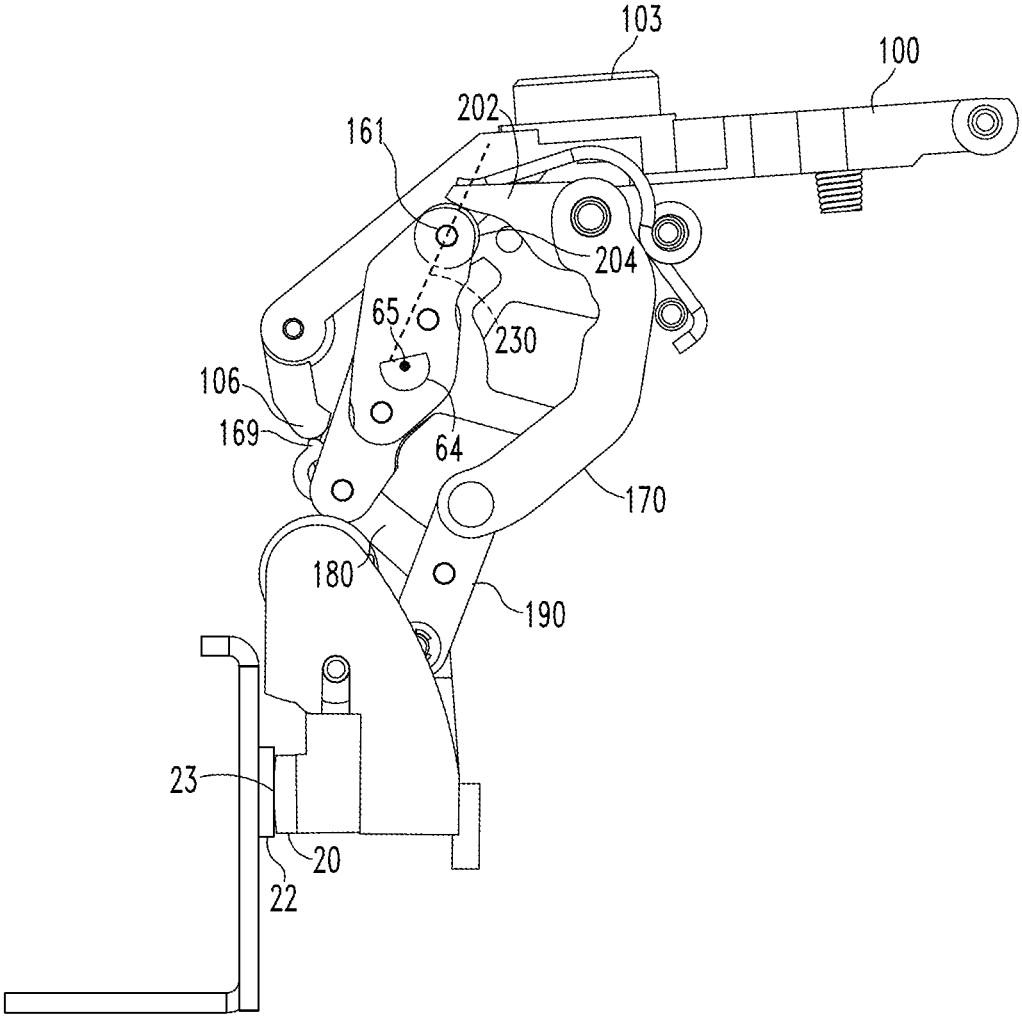

The operating mechanism 16 is operatively coupled to movable contact 20 and is structured to move each movable contact 20 between an open, first position, wherein the movable contact 20 is spaced from, and not in electrical communication with, the fixed contact 22, and a closed, second position, wherein the movable contact 20 is coupled to or directly coupled to, and is in electrical communication with, the fixed contact 22. When the movable contact 20 is in the second position, a "use" current passes through the circuit breaker assembly 10. Further, in an exemplary embodiment, the movable contact 20 is structured as a "wiping contact." As used herein, a "wiping contact" means a movable contact that slides over the surface of the fixed contact as the movable contact moves into the second position. Thus, as shown in FIG. 9, as the movable contact 20 moves into the second position, the movable contact 20 initially touches the fixed contact 22 at an initial interface 23. When the movable contact 20 is fully in the second position, as shown in FIG. 10, the point of the initial interface 23 is moved (upwardly as shown, also shown exaggerated for clarity). It is understood that the wiping motion of the movable contact 20 relative to the fixed contact 22 is structured to, and does, remove debris such as, but not limited to, carbon build up on the pair of contacts 20, 22.

The operating mechanism 16 includes a number of elements such as, but not limited to, a crossbar 30 and the multi-level feedback actuator assembly 50, discussed below. The elements of the operating mechanism 16, including the crossbar 30, move between a number of configurations/positions including configurations/positions corresponding to the position of the movable contact 20. For example, the crossbar 30 moves between at least a first position and a second position; when the crossbar 30 is in its first position, the movable contact 20 is in (or is moving toward) its first position. Similarly, when the crossbar 30 is in its second position, the movable contact 20 is in (or is moving toward) its second position. In an exemplary embodiment, the crossbar 30 is rotatably coupled to the circuit breaker assembly housing assembly 12 and extends generally laterally across the circuit breaker assembly housing assembly 12. The crossbar 30 includes an elongated body 32. The crossbar body 32 is structured to be, and is, rotatably coupled to the circuit breaker assembly housing assembly 12. Further, the crossbar body 32 includes at least one radial extension 34, i.e., an extension that extends generally radially relative to the crossbar body 32 axis of rotation. At least one rotational coupling 36, which is shown as an axle 38, is disposed on the crossbar body radial extension 34. Further, the movable contact 20 is coupled, directly coupled, or fixed to the crossbar body 32 and, as shown, is disposed on a radial extension 34. The fixed contact 22 is, in an exemplary embodiment, coupled to the housing assembly 12 adjacent/within the movable contact 20 path of travel. The axis of rotation of the crossbar body radial extension rotational coupling 36, i.e., crossbar body axle 38, extends generally parallel to the crossbar body 32 axis of rotation.

As is known, and as discussed above, when an overcurrent event is detected, the solid state interrupter assembly 40 interrupts the current. Once the current is interrupted within the solid state interrupter assembly 40, the trip assembly 18 is structured to move the operating mechanism 16 from the second configuration/position to the first configuration/position in the event of an over-current condition. That is, the trip assembly 18 is structured to cause the operating mechanism 16 to open the contacts 20, 22 in the event of an over-current condition. Stated alternately, the trip assembly 18 is structured to cause the operating mechanism 16 to move the movable contact 20 from the second position to the first position in the event of an over-current condition. This is typically accomplished by biasing devices such as, but not limited to a rotary solenoid 60 (discussed below), that cause elements of the operating mechanism 16 to move from the second configuration to the first configuration.

Figure 2:
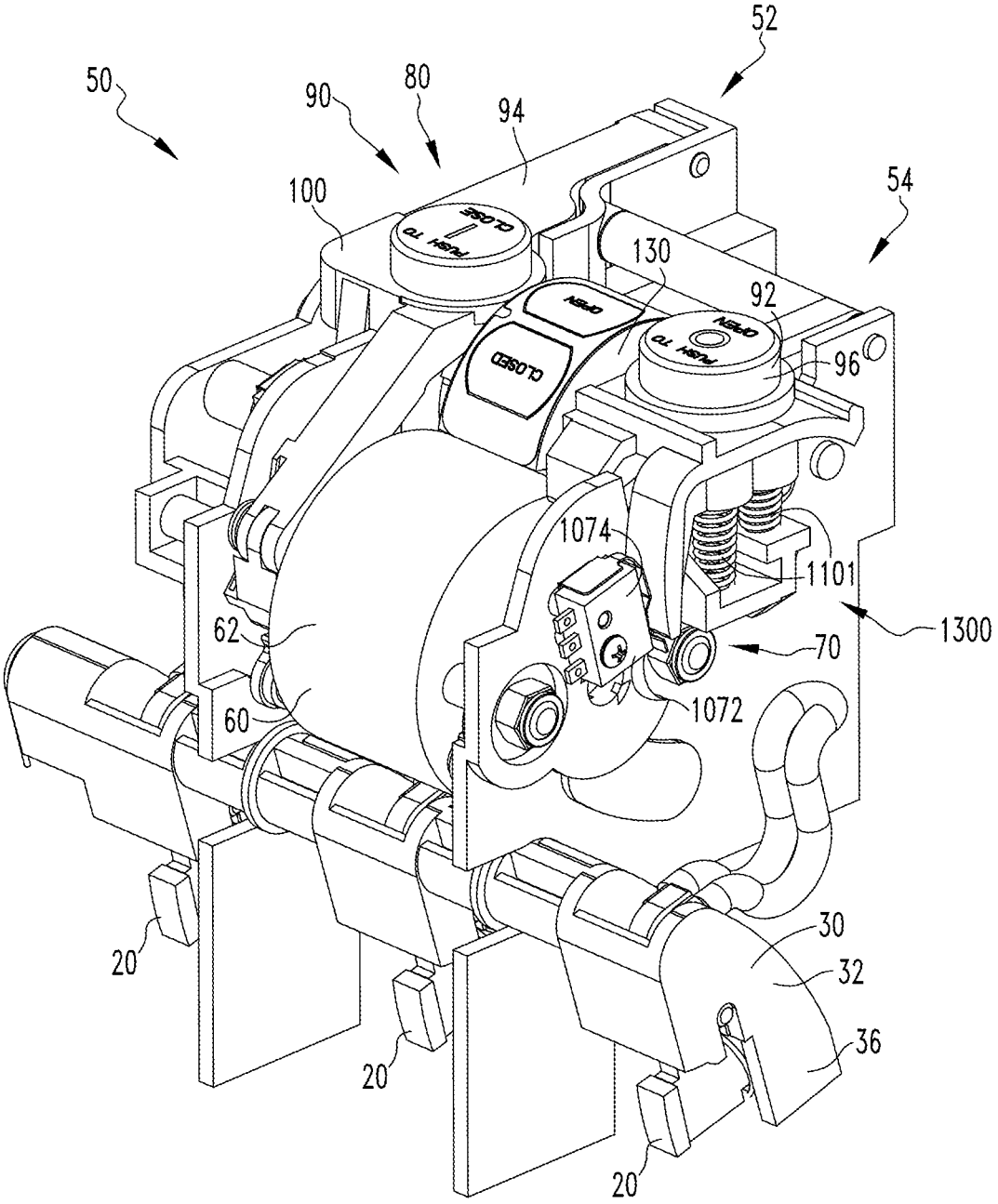
FIG. 2 is an isometric view of a multi-level feedback actuator assembly.
Figure 3:
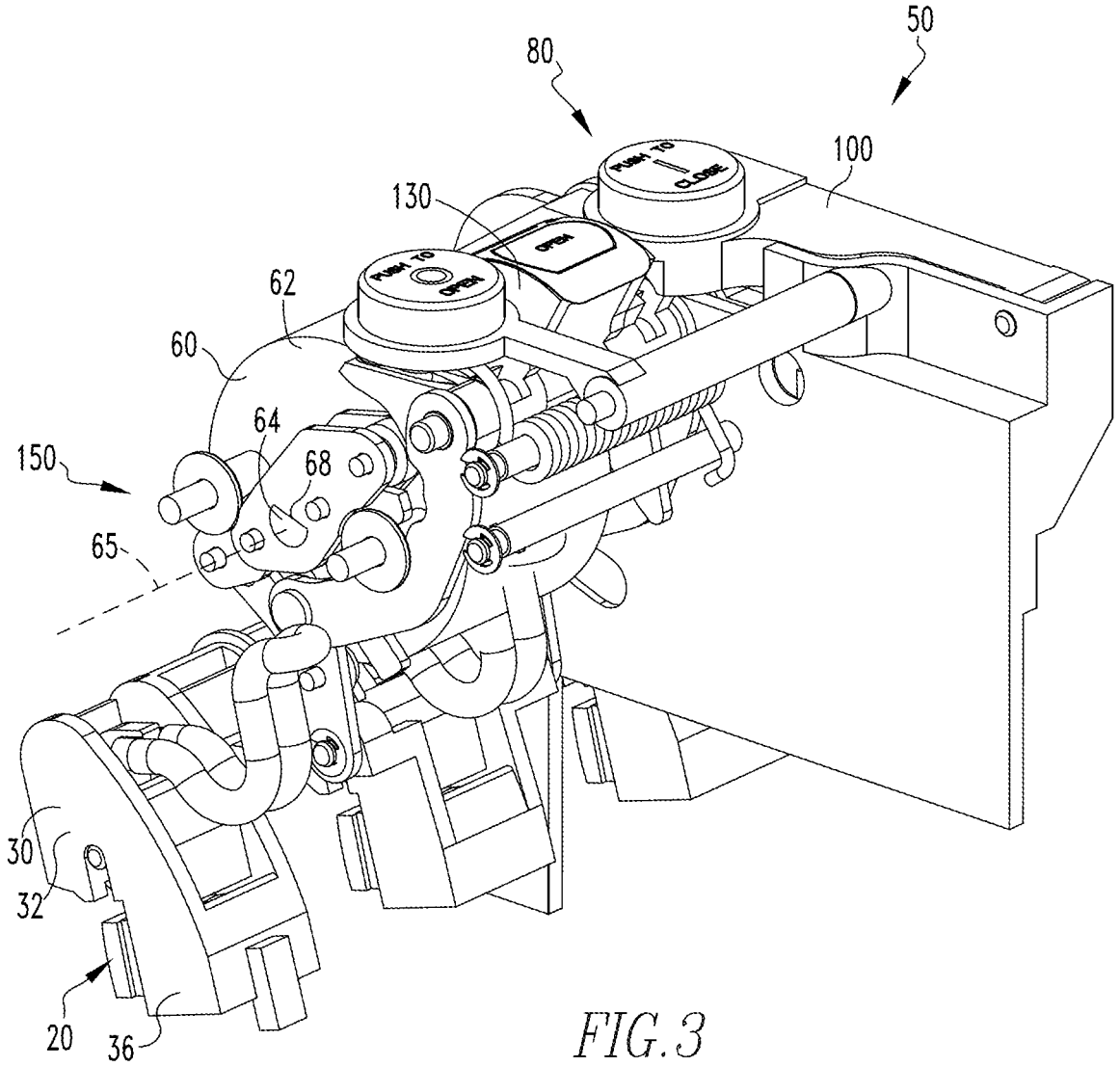
FIG. 3 is another isometric view of a multi-level feedback actuator assembly.
Figure 4A:
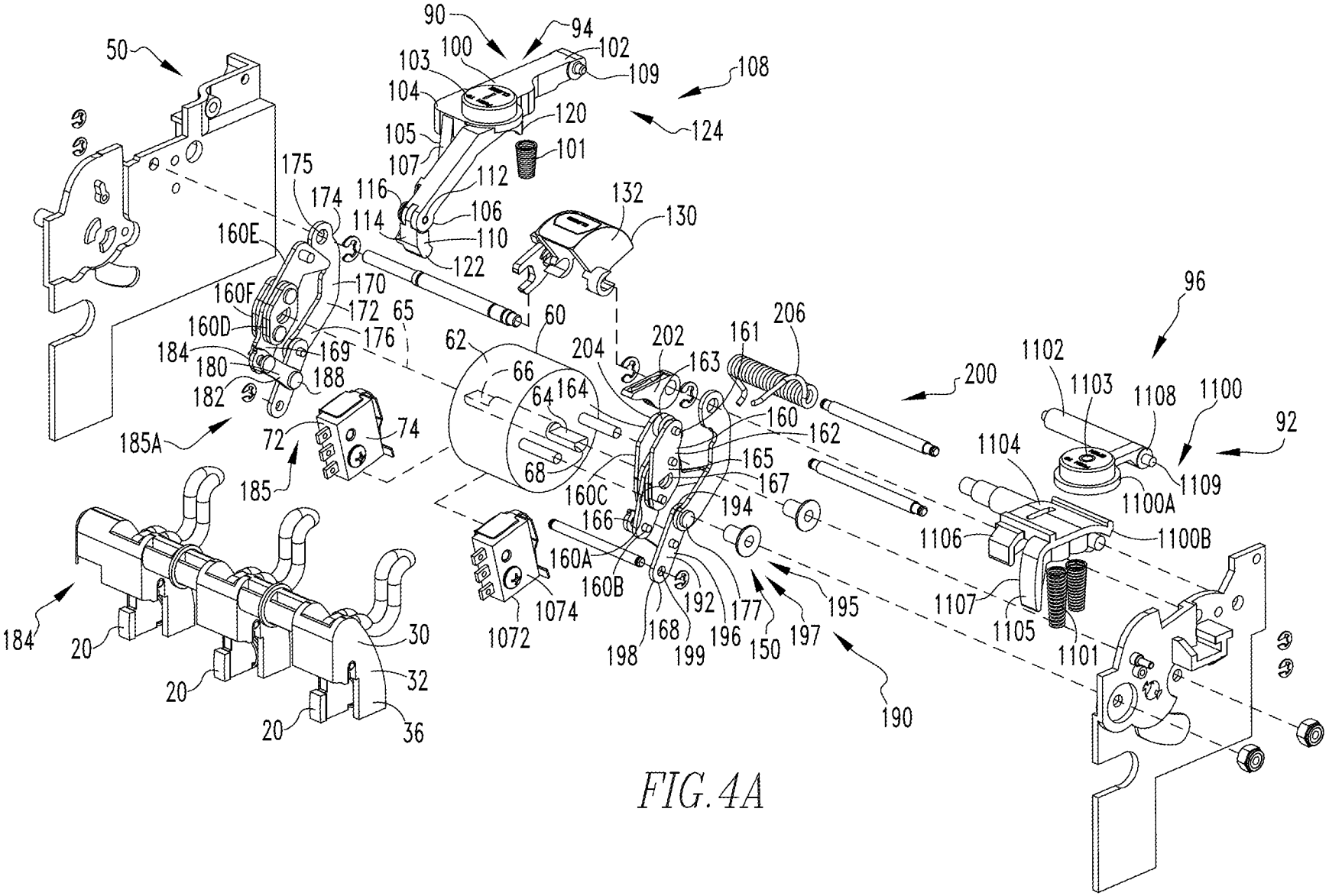
FIGS. 4A and 4B are an exploded isometric view of a multi-level feedback actuator assembly.
Figure 4B:
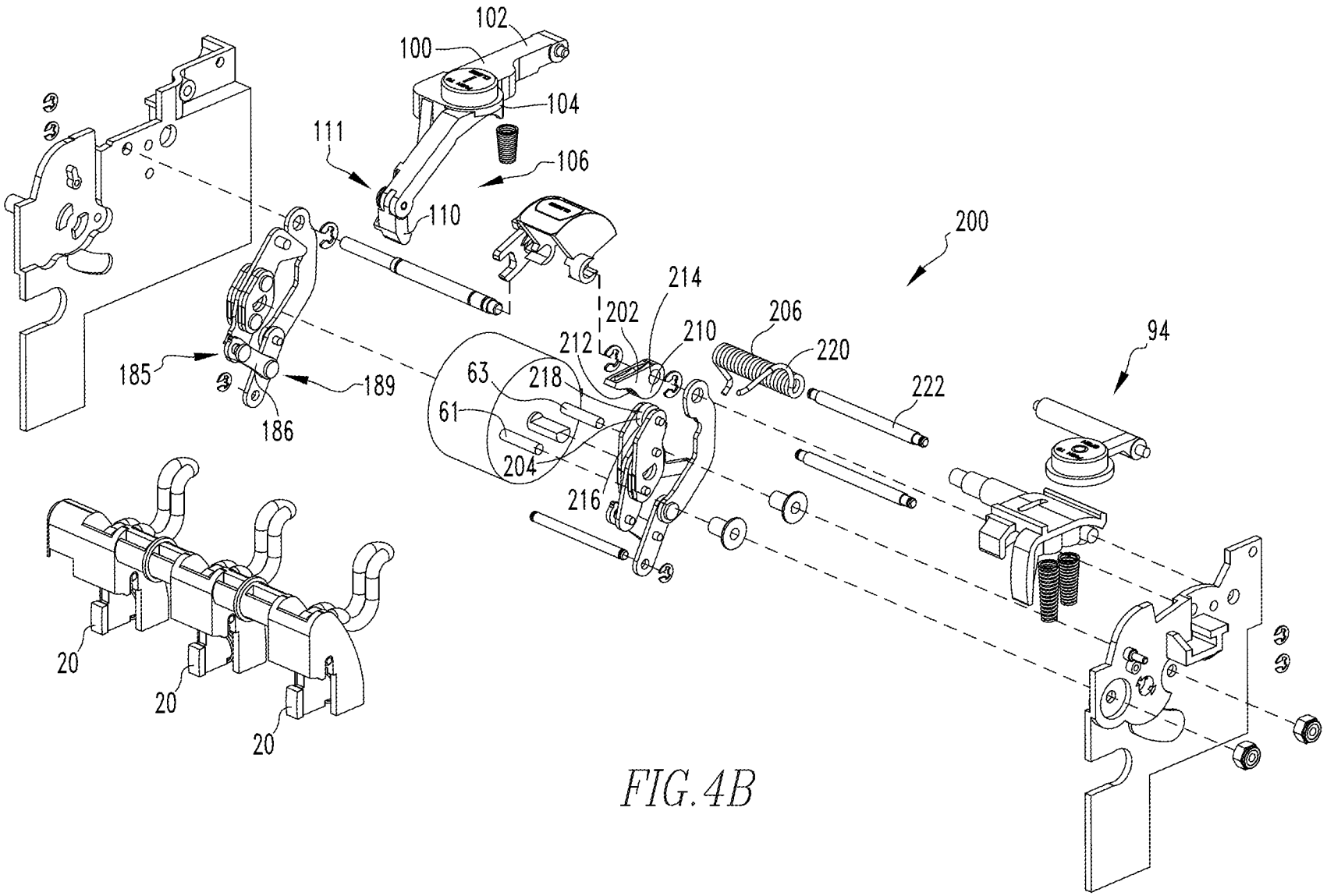

In an exemplary embodiment, the operating mechanism 16 includes a multi-level feedback actuator assembly 50, as shown in FIGS. 2-4. The multi-level feedback actuator assembly 50 is structured to, and does, move the operating mechanism 16, and therefore the movable contact 20, between the first and second configurations/positions. In one embodiment, the multi-level feedback actuator 50 is a multi-level feedback closing actuator assembly 52 that is structured to, and does, move the operating mechanism 16, and therefore the movable contact 20, from the first configuration/position to the second configuration/position. That is, in one embodiment, the multi-level feedback actuator 50 is structured to, and does, close the contacts 20, 22.

In another embodiment, the multi-level feedback actuator 50 is a multi-level feedback opening actuator assembly 54 that is structured to, and does, move the operating mechanism 16, and therefore the movable contact 20, from the second configuration/position to the first configuration/position. That is, in one embodiment, the multi-level feedback actuator 50 is structured to, and does, open the contacts 20, 22.

In another embodiment, the multi-level feedback actuator 50 includes both a multi-level feedback closing actuator assembly 52 (hereinafter, and as used herein, the "closing actuator assembly" 52) that is structured to, and does, move the movable contact 20 from the first position to the second position, and, a multi-level feedback opening actuator assembly 54 (hereinafter, and as used herein, the "opening actuator assembly" 54) that is structured to, and does, move the movable contact 20 from the second position to the first position.

In the embodiment discussed below, the multi-level feedback actuator 50 includes both a closing actuator assembly 52 and an opening actuator assembly 54. In this embodiment, the multi-level feedback closing actuator assembly 52 and the multi-level feedback opening actuator assembly 54 share several components which operate, generally, in a similar manner. The following description addresses the closing actuator assembly 52 first, but it is understood that several elements thereof are also identified as part of the opening actuator assembly 54, which is discussed further below. Further, the following description recites a "first" primary actuator 90, 92 (discussed below); as the following discussion initially addresses the closing actuator assembly 52, the initial "first" primary actuator 90 that is identified is an actuator for the closing actuator assembly 52. Subsequently, the description recites a "second" primary actuator 92 that is an actuator for the opening actuator assembly 54. It is, however, understood that in an embodiment with only a closing actuator assembly 52 or only an opening actuator assembly 54, the "first" primary actuator 90, 92 is an actuator for the disclosed assembly. That is, as used herein, a "first" primary actuator 90, 92 is not limited to an actuator for the closing actuator assembly 52.

In an exemplary embodiment, the multi-level feedback actuator assembly 50, or, the closing actuator assembly 52, includes a rotary solenoid 60, an electric actuator assembly 70, and a manual actuator assembly 80. It is understood that both the electric actuator assembly 70 and the manual actuator assembly 80 share/utilize the same components such as, but not limited to, a linkage assembly 150 (described below), even if those components are initially identified as part of only one actuator assembly.

The rotary solenoid 60 includes a housing assembly 62, a coil (not shown) and a rotating output shaft 64. In an exemplary embodiment, the rotary solenoid housing assembly 62 is generally cylindrical and/or disk-like. That is, the rotary solenoid housing assembly 62 includes a generally radial surface and two generally planar axial surfaces, none numbered. In this exemplary embodiment, the rotary solenoid output shaft 64 includes a first end 66 and a second end 68. The rotary solenoid output shaft first end 66 and the rotary solenoid output shaft second end 68 each extend from opposing axial surfaces of the rotary solenoid housing assembly 62. Further, each of the rotary solenoid output shaft first end 66 and the rotary solenoid output shaft second end 68 are non-circular.

As is known, the rotary solenoid output shaft 64 is responsive to current applied to the rotary solenoid coil. That is, the rotary solenoid output shaft 64 is structured to, and does, rotate between a first position and a second position. In one embodiment, application of a current with first characteristics applied to the rotary solenoid coil causes the rotary solenoid output shaft 64 to rotate from the second position to the first position, and, application of a current with second characteristics applied to the rotary solenoid coil causes the rotary solenoid output shaft 64 to rotate from the first position to the second position. In another embodiment, the rotary solenoid 60 includes a biasing device such as, but not limited to, a spring (not shown) that biases the rotary solenoid output shaft 64 to one of the first or second positions. In this embodiment, the rotary solenoid output shaft 64 is maintained in a selected position by the biasing device and moves to the other position when a current is applied to the rotary solenoid coil.

The rotary solenoid 60 is structured to, and does, provide a noticeable feedback when actuated. In an exemplary embodiment, the rotary solenoid 60 rotary solenoid housing assembly 62 includes stops 61, 63 that are disposed in the path of travel of at least one element of the linkage assembly 150 and, as shown, the shaft link 160, discussed below. Thus, when the rotary solenoid output shaft 64 moves between the first and second positions, the linkage assembly 150 impacts the rotary solenoid housing assembly stops 61, 63. Because the stops are disposed outside the rotary solenoid housing assembly 62, the sound of the impact is not muffled and is, therefore, a "noticeable feedback" as defined above. That is, the rotary solenoid 60 is structured to, and does, generate a sound that is audible to a human through the circuit breaker assembly housing assembly 12 and/or generate a vibration that is detectable by a human via the multi-level feedback actuator assembly 50. This solves the problem(s) noted above.

In an exemplary embodiment, the rotary solenoid 60 is part of, i.e., is utilized by, both the electric actuator assembly 70 and the manual actuator assembly 80. The electric actuator assembly 70 includes a first switch assembly 72 and a number of conductors such as, but not limited to, wires (shown schematically, not numbered). As with the primary actuators 90, 92, and in an embodiment of the multi-level feedback actuator 50 that includes both a closing actuator assembly 52 and an opening actuator assembly 54, the switch assembly 72 is described as a "first" switch assembly 72 because there is a "second" switch assembly 1072, as discussed below. It is understood that in an embodiment with only a closing actuator assembly 52 or only an opening actuator assembly 54, the switch assembly 72, 1072 would not be identified by the terms "first" and "second" as there would be a single switch assembly 72, 1072. As is known, the switch assembly conductors are coupled to, and are in electric communication with, the rotary solenoid coil. Thus, when the switch assembly 72, 1072 is actuated, a charge/current is applied to the rotary solenoid coil and the rotary solenoid output shaft 64 moves between positions. That is, the switch assembly 72, 1072 is structured to, and does, hold a charge (or otherwise selectively allow a current to pass therethrough) that is sufficient to cause the rotary solenoid output shaft 64 to move between positions. In an exemplary embodiment, the switch assembly 72, 1072 includes a number of capacitors (none shown). Regardless of the configuration of the switch assembly 72, 1072, the switch assembly 72, 1072 includes (or passes on) a charge/current sufficient to cause the rotary solenoid output shaft 64 to rotate between first/second positions. In another exemplary embodiment, the switch assembly 72, 1072, or a construct in electrical communication with the switch assembly 72, 1072, includes an electrical coupling structured to be connected to a source of power. Thus, if the switch assembly 72, 1072 is not charged, a user is able to charge the switch assembly 72, 1072.

Figure 5:
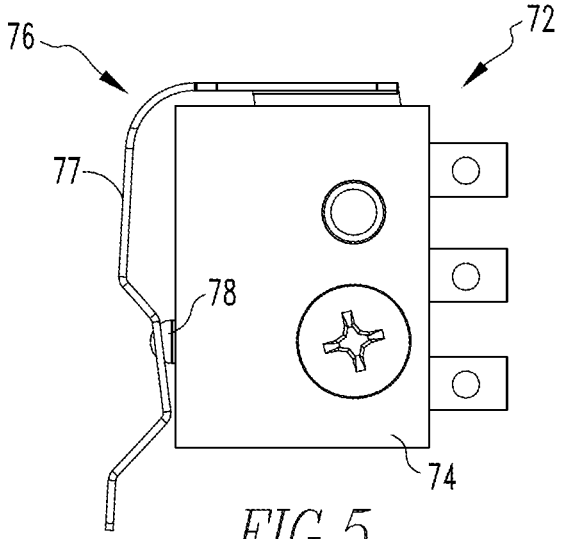
FIG. 5 is side view of a switch assembly.

In an exemplary embodiment, and as shown in FIG. 5, the first switch assembly 72 includes a housing assembly 74 and an actuator 76. As shown, the first switch assembly actuator 76 includes a lever 77/button 78 combination. The first switch assembly actuator 76 is structured to, and does, move between an unactuated, first position and an actuated, second position. When the first switch assembly actuator 76 is moved into the actuated, second position, the first switch assembly 72 passes a charge/current to the rotary solenoid coil. Thus, the first switch assembly 72 is operatively coupled to the rotary solenoid 60 and the first switch assembly 72 is structured to, and does, actuate the rotary solenoid 60.

As shown in FIGS. 2-4, the manual actuator assembly 80 includes a number of primary actuators 90, a flag 130, a linkage assembly 150, and a cam assembly 200. In an embodiment wherein the multi-level feedback actuator assembly 50 includes both a closing (or first) actuator assembly 52 and an opening (or second) actuator assembly 54, the number of primary actuators 90 includes at least a first actuator 94 and a second actuator 96. As discussed above, in this embodiment, the first actuator 94 is associated with, and is structured to actuate, the closing actuator assembly 52. The second actuator 96 is associated with, and is structured to actuate, the opening actuator assembly 54.

The first actuator 94 includes a body 100. As shown in FIG. 4, the first actuator body 100 is elongated and includes a first end 102, a medial portion 104, and a second end 106. The first actuator body first end 102 is structured to be, and is, rotatably coupled to the circuit breaker housing assembly 12. The first actuator body 100 is structured to move between an unactuated first position and an actuated second position. As indicated by the names, when the first actuator body 100 is unactuated, the first actuator body 100 is in the first position. When the first actuator body 100 is fully actuated, it is in the second position. In an exemplary embodiment, the first actuator body first end 102 includes a rotational coupling 108 such as, but not limited to, an axle 109 that is structured to be, and is, coupled to the circuit breaker housing assembly 12. That is, in an exemplary embodiment, the circuit breaker housing assembly 12 includes a circular passage (not numbered) that corresponds to the first actuator body first end axle 109. It is noted that in this configuration, the first actuator body 100 moves, i.e., rotates, generally in a single plane. That is, the longitudinal axis of the first actuator body 100 moves, i.e., rotates, generally in a plane which extends generally perpendicular to the first actuator body first end rotational coupling 108 axis of rotation. The first actuator body medial portion 104 defines a user interface such as, but not limited to, a button 103. In an exemplary embodiment, the first actuator body medial portion 104 also includes a switch assembly interface 107 which is shown as an extension 105 that extends generally opposite the button 103. The first actuator body second end 106 is structured to be, and is, operatively coupled to the linkage assembly 150. Thus, the first actuator body second end 106 is structured to, and does, operatively engage the linkage assembly 150. That is, first actuator body 100 is operatively coupled to the linkage assembly 150 and is structured to, and does, move at least one link 160, 170, 180, 190, discussed below.

Further, as discussed below, the linkage assembly 150 includes elements that move over a generally circular path. The first actuator body 100 also moves over a generally arcuate path (which is also the first actuator 94 "path" as used herein) but, in the embodiment shown, the first actuator body 100 path has a different radius compared to the path of the linkage assembly 150 elements. In this configuration, the first actuator body second end 106 does not move over a path that corresponds to the linkage assembly 150 elements. As such, in this embodiment, the first actuator body second end 106 includes a rotational coupling 111 and a rotating extension assembly 110. The rotating extension assembly 110 includes a rotational coupling 112, an extension body 114, and a biasing device such as, but not limited to, a return spring 116. The rotating extension assembly extension body 114 is elongated and includes a first end 120 and a second end 122. The rotating extension assembly extension body first end 120 includes a rotational coupling 124. The rotating extension assembly extension body second end 122 is structured to, and does, operatively engage the linkage assembly 150. Further, the rotating extension assembly extension body second end 122 is structured to be, and is, operatively engaged by the linkage assembly 150.

The rotating extension assembly 110 is assembled as follows. The rotating extension assembly extension body first end rotational coupling 124 is movably coupled to the first actuator body second end rotational coupling 111. Further, the rotational couplings 108, 111, 124 are oriented so that the longitudinal axis of the rotating extension assembly extension body 114 moves in generally the same plane as, or a generally parallel plane to, the first actuator body's 100 plane of motion. The rotating extension assembly return spring 116 is operatively coupled to both the first actuator body 100 and the rotating extension assembly extension body 114. The rotating extension assembly return spring 116 is structured to, and does, bias the rotating extension assembly extension body 114 toward the linkage assembly 150.

As the rotating extension assembly 110 acts as an extension of the first actuator body 100 hereinafter, and as used herein with respect elements/assemblies other than the first actuator 94, the rotating extension assembly extension body second end 122 is considered the equivalent of the first actuator body second end 106. That is, as used herein, a statement such as "the first actuator body second end 106 operatively engages the linkage assembly 150" means that the rotating extension assembly extension body second end 122 operatively engages the linkage assembly 150.

The second actuator 96 is discussed below in association with the opening actuator assembly 54.

Before discussing the linkage assembly 150 in detail, it is noted that circuit breaker assemblies 10 are well known to include single "links" or "link members" that include a plurality of generally planar laminations. That is, the laminations have generally the same size, shape and other characteristics (or are coupled to each other so as to form separate lamination assemblies having generally the same size, shape and other characteristics) and are, in an exemplary embodiment, coupled to other elements at generally the same locations. Thus, for example, two laminations of a single "link" that are coupled to a rotating element such as, but not limited to, the crossbar 30, appear as a single element when viewed along the crossbar 30 axis of rotation. The laminations are part of the same "link" even when the laminations are spaced from each other. Such laminations are, as used herein, the same "link" or "linkage member." Thus, it is understood that while the Figures may show a "link" having two or more separate laminations, the following description will identify those laminations by a single name and reference number, i.e., the "link" name and reference number. For example, as shown in FIG. 4, the shaft link 160, discussed below, includes a plurality of laminations 160A, 160B, 160C, 160D, 160E, 160F which form a single shaft link 160. That is, even though the various laminations 160A, 160B, 160C, 160D, 160E, 160F have different shapes, the laminations 160A, 160B, 160C, 160D, 160E, 160F are coupled to each other so as to form lamination assemblies, i.e., the "links," wherein the lamination assemblies have generally the same size, shape and other characteristics. That is, as used herein and as shown, the laminations 160A, 160B, 160C and 160D, 160E, 160F or assemblies of laminations 160A, 160B, 160C and 160D, 160E, 160F in a link have "generally the same size, shape and other characteristics." It is noted that selected laminations 160A, 160B, 160C and 160D, 160E, 160F are disposed on opposite sides of rotary solenoid 60 but are, as used herein, a single "link." That is, as stated above, the laminations of a single "link" are, in some embodiments, spaced from each other.

The linkage assembly 150 is structured to be, and is, operatively coupled to the crossbar 30, the rotary solenoid 60 and the first actuator body 100. Thus, the linkage assembly 150 is structured to, and does, operatively engage the crossbar 30, the rotary solenoid 60 and the first actuator body 100. Further, the crossbar 30 is structured to be, and is, operatively coupled to the linkage assembly 150 and, as such, is structured to, and does, operatively engage the linkage assembly 150. Similarly, the rotary solenoid 60 is structured to be, and is, operatively coupled to the linkage assembly 150 and, as such, is structured to, and does, operatively engage the linkage assembly 150. Similarly, the first actuator body 100 is structured to be, and is, operatively coupled to the linkage assembly 150 and, as such, is structured to, and does, operatively engage the linkage assembly 150. That is, generally, forces/bias applied to any of the crossbar 30, the rotary solenoid 60, the first actuator body 100 and the linkage assembly 150 are transferred to the elements operatively coupled thereto. Further, as detailed below, the linkage assembly 150 is structured to apply at least a first bias to the first actuator body 100 and a second bias to the first actuator body 100. The first bias is noticeably different from said second bias.

In this configuration, the multi-level feedback actuator assembly 50 is structured to, and does, provide an "indicative feedback." As used herein, an "indicative feedback" means that noticeably different forces/biases are applied to a user interface such as, but not limited to, a first actuator 94, so that, when a user actuated the user interface, the user is able to sense and differentiate the noticeably different forces/bias applied to a user interface via the user interface. Prior to use, the user is informed as to what the indicative feedback indicates. For example, the user is informed, e.g., via a user manual, that one type of bias/feedback indicates that a lesser bias/feedback indicates that the first actuator 94 is actuating the electric actuator assembly 70 and a greater bias/feedback indicates that the first actuator 94 is actuating the manual actuator assembly 80.

In an exemplary embodiment, the linkage assembly 150 includes a shaft link 160, an upper link 170, a middle link 180 and a lower link 190. The shaft link 160 includes an elongated body 162 having a first end 164, a medial portion 165, and a second end 166. Each of the shaft link body first end 164, shaft link body medial portion 165 and shaft link body second end 166 include a coupling. In an exemplary embodiment, the shaft link 160 includes at least two laminations (not numbered) that are spaced from each other and thereby define a yoke (not numbered). In an exemplary embodiment, the shaft link body first end 164 defines a rotational coupling 161. In an exemplary embodiment, a yoke at the shaft link body first end 164 includes two openings (not numbered) which are the shaft link body first end coupling 161. Further, a wheel 163 having an axle (not numbered) is rotatably coupled to the shaft link body first end 164 yoke openings. As discussed below, the wheel 163 is also identified as the cam assembly second cam member 204 (discussed below). The wheel 163, and therefore the shaft link body first end 164, is structured to, and does, operatively engage the cam assembly first cam member 202, discussed below. Similarly, the cam assembly first cam member 202 is structured to, and does, operatively engage the wheel 163, and therefore the shaft link body first end 164. In an alternate embodiment, the shaft link body first end 164 defines a cam surface (not shown) which is the second cam member that is structured to, and does, operatively engage the cam assembly first cam member 202.

The shaft link body medial portion 165 coupling includes an opening 167 that is shaped to substantially correspond to the longitudinal cross-sectional shape of the rotary solenoid output shaft 64. In this configuration, the shaft link body medial portion 165 is structured to be, and is, fixed to the rotary solenoid output shaft 64. Thus, the shaft link 160 rotates with the rotary solenoid output shaft 64. That is, the rotary solenoid output shaft 64 is operatively coupled to, and therefore operatively engages, the shaft link 160. Similarly, the shaft link 160 is operatively coupled to, and therefore operatively engages, the rotary solenoid output shaft 64.

The shaft link body second end 166 coupling is a rotational coupling such as a substantially circular opening 168. The shaft link body second end 166 coupling is structured to be, and is, rotationally coupled to the middle link 180. Further, an edge surface of the shaft link body second end 166 is structured to be, and is, a first actuator interface 169. In an exemplary embodiment, the shaft link body second end first actuator interface 169 is disposed between the shaft link body medial portion opening 167 and the shaft link body second end opening 168.

The upper link 170 includes a body 172. The upper link body 172 is elongated and, as shown, generally curvilinear. The upper link body 172 includes a first end 174 and a second end 176. Each of the upper link body first end 174 and second end 176 include a coupling such as, but not limited to, a rotational coupling. As shown, each of the upper link body first end 174 and second end 176 include a substantially circular opening 175, 177.

The middle link 180 includes a body 182. The middle link body 182 is elongated and, as shown, generally straight. The middle link body 182 includes a first end 184 and a second end 188. Each of the middle link body first end 184 and second end 188 include a coupling such as, but not limited to, a rotational coupling. In an exemplary embodiment, each of the middle link body first end 184 and second end 188 include a substantially circular opening 185, 189, respectively. In another exemplary embodiment, however, the middle link body first end opening 185 is an elongated slot 185A with a longitudinal axis that extends along, or generally parallel to, the middle link body 182 longitudinal axis. It is noted that when the middle link body first end opening 185 is an elongated slot 185A, an element coupled thereto is able to move within the slot without causing the middle link body 182 to move. That is, for example and as discussed below, the shaft link body 162 is coupled to the middle link body first end 184 by a pin (not numbered). Thus, when the shaft link body 162 moves, the pin moves in the middle link body first end slot 185A until the pin abuts an end of the slot 185A. Only when the pin abuts an end to the slot 185A is the motion of the shaft link body 162 transferred to the middle link body 182.

The lower link 190 includes a body 192. The lower link body 192 is elongated and, as shown, generally straight. The lower link body 192 includes a first end 194, a medial portion 196 and a second end 198. Each of the lower link body first end 194, medial portion 196 and second end 198 include a coupling such as, but not limited to, a rotational coupling. As shown, each of the lower link body first end 194, medial portion 196 and second end 198 include a substantially circular opening 195, 197, 199.

The cam assembly 200 includes a first cam member 202, a second cam member 204 and a bias device 206. In an exemplary embodiment, the cam assembly first cam member 202 includes a generally planar body 210 that defines a rotational coupling and a cam surface 212. That is, the cam assembly first cam member body 210 defines a substantially circular opening 214. The circuit breaker assembly housing assembly axle 15 is structured to be, and is, a rotational mounting for the cam assembly first cam member body 210. That is, the circuit breaker assembly housing assembly axle 15 extends through the cam assembly first cam member body opening 214. The circuit breaker assembly housing assembly axle 15 is disposed adjacent, or immediately adjacent, the shaft link body first end 164 path of travel, as discussed below. In an exemplary embodiment, the edge surface of the cam assembly first cam member body 210 that is disposed adjacent the shaft link body first end 164 path of travel defines the cam assembly first cam member body cam surface 212. Further, in an exemplary embodiment, the cam assembly first cam member body cam surface 212 is generally curvilinear. As discussed above, the cam assembly second cam member 204 is, in an exemplary embodiment, the wheel 163. That is, the cam assembly second cam member 204 includes a generally circular, i.e., a disk-like, body 216 wherein the radial surface is a generally circular cam surface 218.

In an exemplary embodiment, the cam assembly bias device 206 is a spring 220 that is structured to, and does, engage/apply bias to at least one of the cam assembly first cam member 202 or the cam assembly second cam member 204. The cam assembly bias device 206 is structured to, and does, create a line of force 230, discussed below, extending from a point of contact between the cam assembly first cam member 202 and the second cam member 204 through the shaft link body first end coupling 161. In an exemplary embodiment, the circuit breaker assembly housing assembly 12 includes a spring mounting 222 disposed adjacent to the circuit breaker assembly housing assembly axle 15. The cam assembly bias device 206, i.e., spring 220, is coupled, directly coupled, or fixed to the circuit breaker assembly housing assembly spring mounting 222.

The multi-level feedback actuator assembly 50 is assembled as follows. The rotary solenoid 60 is disposed in the circuit breaker assembly housing assembly enclosed space 13. As is known, the circuit breaker assembly housing assembly 12 includes a mounting (not numbered) structured to support the rotary solenoid 60. Thus, the rotary solenoid 60 is coupled, directly coupled, or fixed to the circuit breaker assembly housing assembly 12. As shown, and in an exemplary embodiment, the axis of rotation 65 of the rotary solenoid output shaft 64 extends generally parallel to the axis of rotation of the crossbar 30.

The shaft link 160 is coupled, directly coupled, or fixed to the rotary solenoid output shaft 64. In an exemplary embodiment, the shaft link body medial portion opening 167 is directly coupled to the rotary solenoid output shaft 64. Further, because the rotary solenoid output shaft 64 and the shaft link body medial portion opening 167 are both non-circular (and have corresponding shapes), the shaft link 160 is fixed to the rotary solenoid output shaft 64 and rotates therewith. Further, in this configuration, forces and biases applied by either the shaft link 160 or the rotary solenoid output shaft 64 is transferred to the other. Further, as the rotary solenoid output shaft 64 rotates and as the shaft link 160 moves therewith, the shaft link 160, and its sub-components, each have a path of travel. As noted above, the wheel 163, i.e., the cam assembly second cam member 204, is rotatably coupled to the shaft link body first end 164. The shaft link body second end 166 is rotatably coupled to the middle link body first end 184.

In an exemplary embodiment, the upper link body first end 174 is rotatably coupled to the circuit breaker assembly housing assembly axle 15. That is, the circuit breaker assembly housing assembly axle 15 extends through the upper link body first end opening 175. The upper link body second end 176 is rotatably coupled to the lower link body first end 194. That is, in an exemplary embodiment, an axle or pin (not numbered) extends through both the upper link body second end opening 177 and the lower link body first end opening 195.

The middle link body second end 188 is rotatably coupled to the lower link body 192. In an exemplary embodiment, an axle or pin (not numbered) extends through both the middle link body second end opening 189 and the lower link body medial portion opening 197. Thus, the middle link 180, i.e., the middle link body 182 extends between, and is rotatably coupled to both, the shaft link 160, i.e., the shaft link body 162, and the lower link 190, i.e., lower link body 192. The lower link body 192 is further rotatably coupled to the crossbar 30. In an exemplary embodiment, the lower link body second end opening 199 is rotatably coupled to the crossbar body radial extension rotational coupling 36, i.e., crossbar body axle 38.

As shown in the figures, the axis of rotation for each rotational coupling in the linkage assembly 150 extends generally, or substantially, parallel to the crossbar body 32 axis of rotation. Further, while not discussed in detail, as is known in the art, the motion of the various links in the linkage assembly 150 are, in an exemplary embodiment, stopped or limited by stop pins, not numbered. It is understood that the stop pins are positioned to stop/limit the motion of the linkage assembly 150 to the first and second position of the movable contact 20. That is, for example, if the links of the linkage assembly 150 are moving in a first direction as the movable contact 20 moves into the first position, the stop pins are positioned so as to stop the motion of the links of the linkage assembly 150 in the first direction once the movable contact 20 is in the first position.

The cam assembly first cam member 202 is rotatably coupled to the circuit breaker assembly housing assembly axle 15 and is disposed adjacent, or immediately adjacent, the shaft link body first end 164 path of travel. Further, the cam assembly bias device 206, i.e., spring 220, is disposed adjacent the cam assembly first cam member 202 and is structured to, and does, bias the cam assembly first cam member 202 toward the cam assembly second cam member 204, i.e., wheel 163. That is, the cam assembly bias device 206 causes the cam assembly first cam member 202 to operatively engage the cam assembly second cam member 204.

Figure 6:
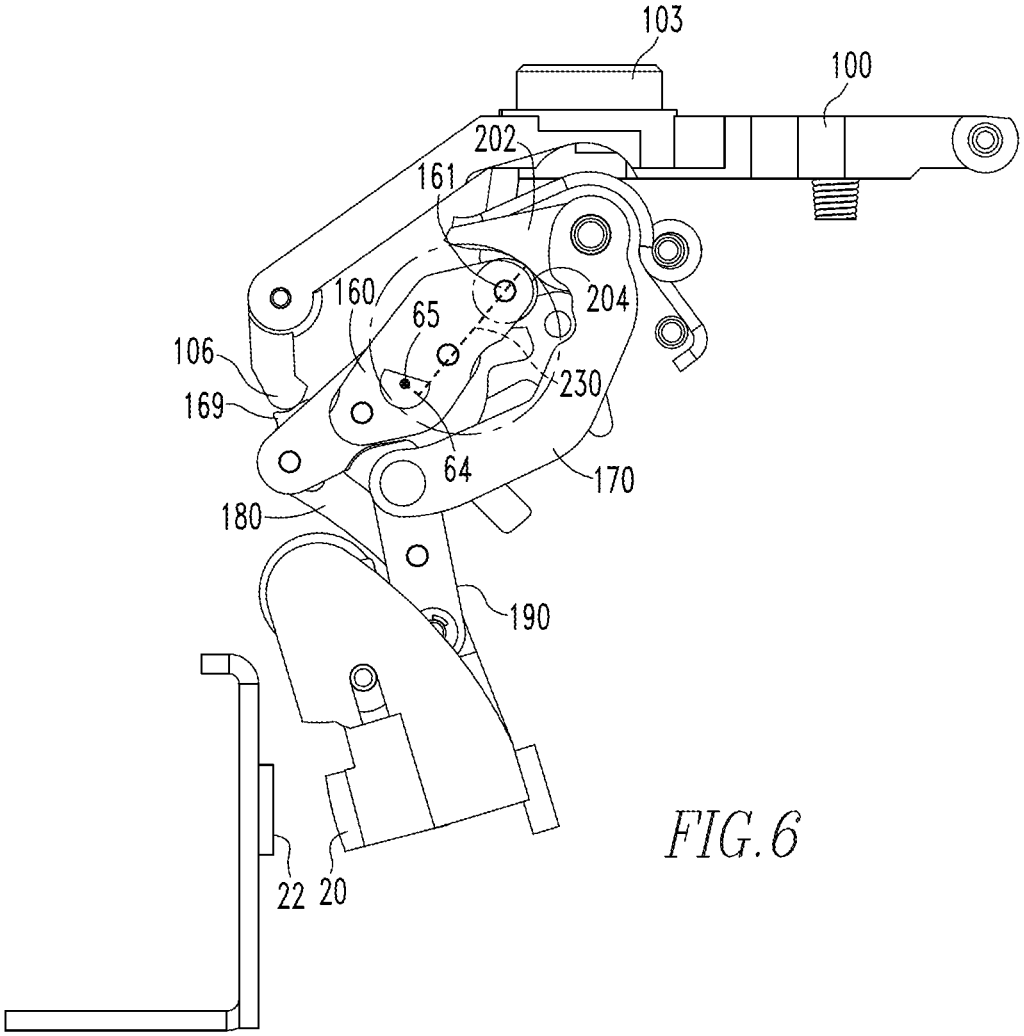
FIGS. 6-10 are partial sides views of a multi-level feedback closing actuator assembly with a limited number of elements identified.
Figure 7:
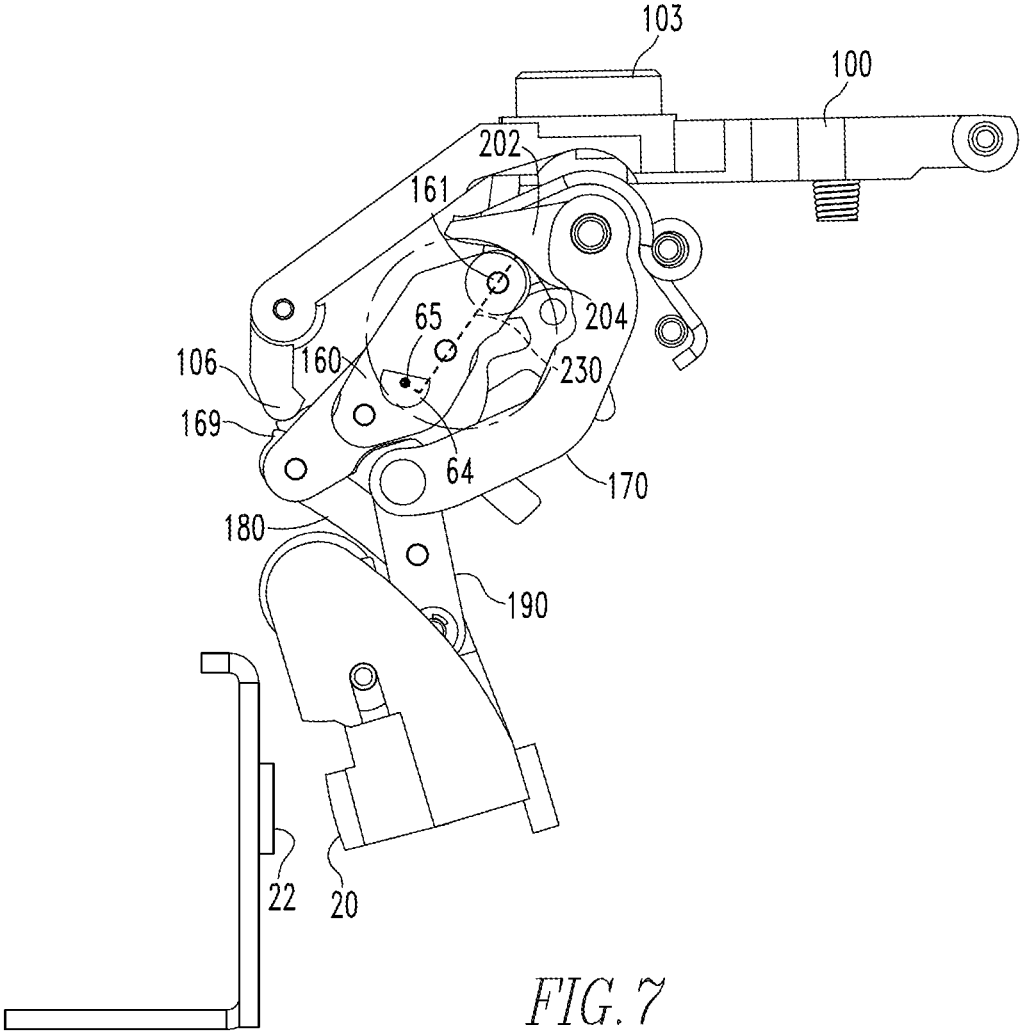
Figure 8:
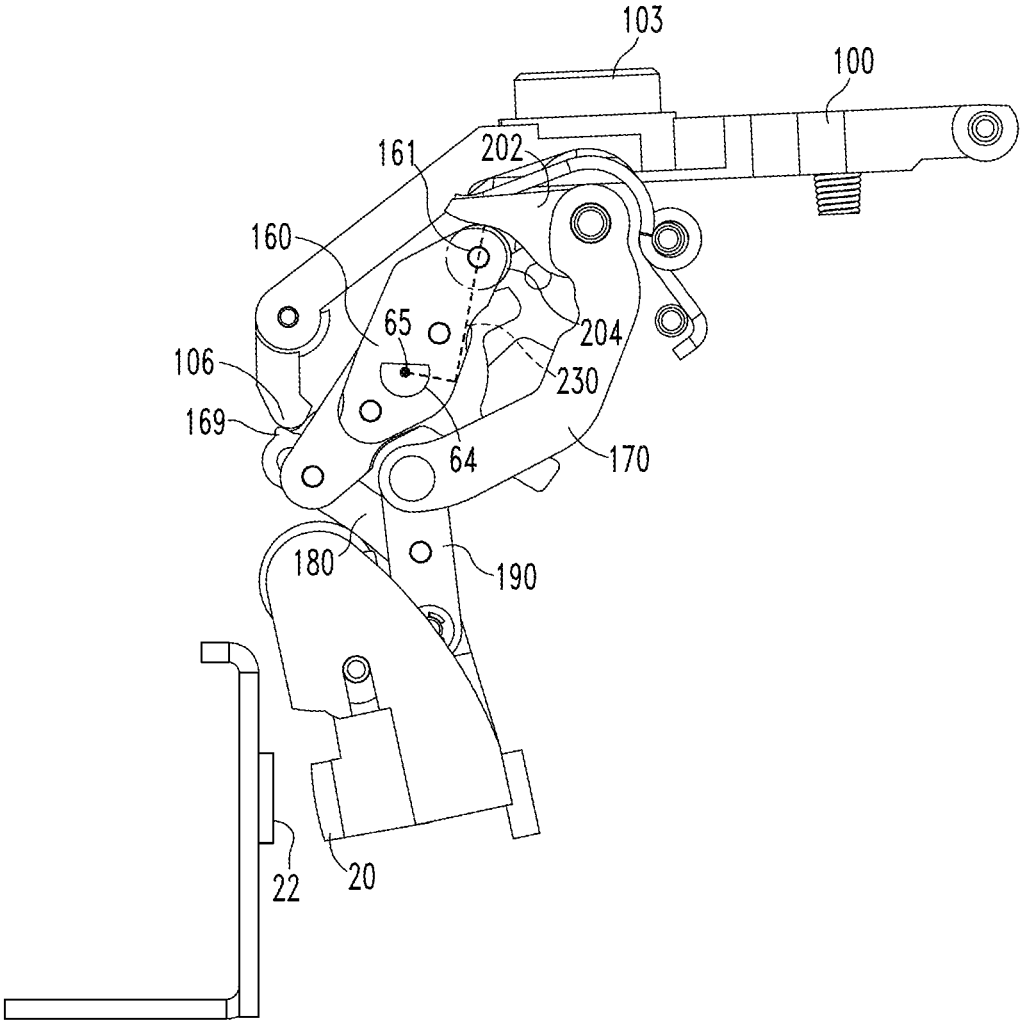

The first actuator body 100 is rotatably coupled to the circuit breaker housing assembly 12. That is, the first actuator body first end 102 is rotatably coupled to the circuit breaker housing assembly 12. In this configuration, the first actuator body 100 has a path of travel. Further, the first actuator body medial portion user interface, i.e., button 103 is disposed on the outside of the circuit breaker housing assembly 12. The first actuator body second end 106 is operatively coupled to the linkage assembly 150. That is, the first actuator body second end 106 is operatively coupled to the shaft link body second end first actuator interface 169. As shown in FIG. 6, the first actuator body second end 106 abuts the shaft link body second end first actuator interface 169 and, as the first actuator body 100 moves over the first actuator body 100 path second portion (as discussed below), the first actuator body second end 106 engages the shaft link body second end first actuator interface 169. Further, the multi-level feedback actuator assembly 50 includes an actuator spring 101. The multi-level feedback actuator assembly actuator spring 101 is disposed between the first actuator body 100 and the circuit breaker housing assembly 12. The multi-level feedback actuator assembly actuator spring 101 is structured to, and does, bias the first actuator body 100 to a first position, as described below.

The first switch assembly 72 is disposed adjacent the first actuator body 100 path of travel. That is, the first switch assembly 72 is positioned so that the first switch assembly actuator 76 is disposed in the path of travel of the first actuator body medial portion switch assembly interface 107. As noted above, the first switch assembly 72 is further operatively coupled to the rotary solenoid 60 and actuation of the first switch assembly actuator 76 causes the rotary solenoid 60 to actuate.

The flag 130 includes a body 132 having two indicia (not numbered) thereon. The indicia are different and are associated with the position of the movable contact 22. As shown, the indicia are the words "open" and "closed." The flag 130, i.e., flag body 132, is operatively coupled to the crossbar 30 and moves therewith into corresponding positions. That is, when the crossbar 30 is in the first position, the flag 130 is in a first position, and, when the crossbar 30 is in the second position, the flag 130 is in a second position. As discussed above, the circuit breaker assembly housing assembly 12 includes an opening, or "window," through which only one of the indicia is visible. When the crossbar 30 is in the first position, the "open" indicia is visible. When the crossbar 30 is in the second position, the "closed" indicia is visible.

In this configuration, the first actuator body 100 is operatively coupled to the linkage assembly 150 and is structured to, and does, move at least one link member, e.g., shaft link 160. Further, the linkage assembly 150 is operatively coupled to the first actuator body 100, the rotary solenoid output shaft 64 and the cam assembly 200. Further, the cam assembly 200 is operatively coupled to the linkage assembly 150. Further, the cam assembly bias device 206 is structured to, and does, apply a bias to at least one of said first cam member 202 and/or the second cam member 204. Further, the cam assembly 200 is structured to, and does, apply bias to the linkage assembly 150.

In this configuration, the first actuator body 100 is structured to, and does, move over a path having at least a first portion and a second portion as it moves between its first position and its second position. As described below, and as used herein, the first actuator body 100 path "first portion" and "second portion" are those portions of the first actuator body 100 path wherein the first actuator body 100 operatively engages different sets of elements of the multi-level feedback actuator assembly 50. That is, as used herein, the first actuator body 100 path "first portion" is that portion of the first actuator body 100 path wherein the first actuator body 100 operatively engages the first switch assembly 72, i.e., the first switch assembly actuator 76. The first actuator body 100 path "second portion" is that portion of the first actuator body 100 path wherein the first actuator body 100 operatively engages the linkage assembly 150 as well as the first switch assembly 72. When the first actuator body 100 is at the end of the first actuator body 100 path "second portion," the first actuator body 100 is in the second position. It is noted that in some configurations the first actuator body 100 moves over a path wherein the first actuator body 100 does not operatively engage another element of the multi-level feedback actuator assembly 50. Such a portion of the first actuator body 100 path is, as used herein, a "null portion" of the first actuator body 100 path, i.e., an embodiment wherein the middle link body first end opening 185 is an elongated slot 185A.

Further, the linkage assembly 150 is structured to, and does, apply at least a first bias to the first actuator body 100 and a second bias to the first actuator body 100. Further, the first bias is noticeably different from the second bias. That is, the linkage assembly 100 is structured to apply the first bias to the first actuator body 100 when the first actuator body 100 is disposed in the first actuator body 100 path first portion, and, the linkage assembly 150 is structured to, and does, apply the second bias to the first actuator body 100 when the first actuator body 100 is disposed in the first actuator body 100 path second portion.

That is, the multi-level feedback actuator assembly 50 operates as follows. Initially, for the sake of this example using a closing actuator assembly 52, it is assumed that the movable contact 20 is in the open, first position and the operating mechanism 16 is in the corresponding first configuration, i.e., the crossbar 30 is in a first position. Further, the first actuator body 100 is in the unactuated, first position.

When a user actuates the first actuator body medial portion user interface, i.e., when the user presses button 103, the first actuator body 100 moves over the first actuator body 100 path first portion. As the first actuator body 100 moves over the first actuator body 100 path first portion, the first actuator body 100, and as shown, the first actuator body medial portion switch assembly interface 107 engages, and actuates, the first switch assembly actuator 76. Thus, first actuator body 100 is structured to, and does, operatively engage the first switch assembly actuator 76 when the first actuator body 100 is disposed in the first actuator body 100 path first portion. As discussed above, following actuation of the first switch assembly actuator 76, the rotary solenoid 60 is actuated and moves the rotary solenoid output shaft 64 from a first position to a second position. Rotation of the rotary solenoid output shaft 64 causes the linkage assembly 150 to move from a first configuration to a second configuration which, in turn, causes the crossbar 30 (and other elements of the operating mechanism 16) to move from a first position/configuration to a second position/configuration. As discussed above, when the operating mechanism 16 moves from a first configuration to a second configuration, the movable contact 20 moves from the first position to the second position. That is, the movable contact 20 closes.

This is the normal operation of the electric actuator assembly 70. That is, the electric actuator assembly 70 includes the first actuator 94, the rotary solenoid 60, and the first switch assembly 72. Further, as discussed below, actuating the electric actuator assembly 70 requires minimal force on the first actuator 94. That is, the counter, or feedback, forces applied by the electric actuator assembly 70 are relatively low when compared to the feedback forces generated by the manual actuator assembly 80, as discussed below. Thus, there is a first bias applied to the first actuator 94 as the first actuator 94 moves over the first actuator body 100 path first portion. Further, if the electric actuator assembly 70 actuates the rotary solenoid 60, there is a noticeable feedback, as described above. Further, the flag 130 moves from its first position to its second position indicating that the movable contact 20 is in the second position. Thus, the user is informed that the electric actuator assembly 70 has moved the movable contact 20 from the first position to the second position and the user stops pressing on the first actuator body medial portion user interface, i.e., button 103.

If the electric actuator assembly 70 is not able to move the movable contact 20 from the first position to the second position, e.g., if the first switch assembly 72 is not able to provide a charge to the rotary solenoid 60, then the user must utilize the manual actuator assembly 80 to move the movable contact 20 from the first position to the second position. This is accomplished by continuing to press on the first actuator body medial portion user interface, i.e., button 103.

That is, as the user continues to press on the first actuator body medial portion user interface, i.e., button 103, the first actuator body 100 moves into the first actuator body 100 path second portion. As the first actuator body 100 moves into the first actuator body 100 path second portion, the first actuator body 100 engages the linkage assembly 150. That is, the first actuator body second end 106 engages the shaft link body second end first actuator interface 169. This bias causes the shaft link 160 to rotate. Thus, the first actuator body 100 is structured to, and does, operatively engage the linkage assembly 150 when the first actuator body 100 is disposed in the first actuator body 100 path second portion. As noted above, the shaft link 160 is operatively coupled to the rotary solenoid output shaft 64, thus, rotation of the shaft link 160 causes the rotary solenoid output shaft 64 to rotate from a first position to a second position and generates a noticeable feedback. Further, as described above, rotation of the rotary solenoid output shaft 64 causes the operating mechanism 16, and therefore the movable contact 20, to move into their second positions/configurations.

In general, the linkage assembly 150 provides a counter, or feedback, bias/force to the first actuator body 100. In an exemplary embodiment, the bias the linkage assembly 150 provides to the first actuator body 100 while the first actuator body 100 is in the first actuator body 100 path first portion is less than the bias the linkage assembly 150 provides to the first actuator body 100 while the first actuator body 100 is in the first actuator body 100 path second portion. This is accomplished, at least in part, by the forces generated in the cam assembly 200.

That is, as noted above and as shown in FIGS. 6-10, the cam assembly bias device 206 creates a line of force 230 extending from a point of contact between the cam assembly first cam member 202 and the second cam member 204 through shaft link body first end coupling 161. Initially, i.e., when the first actuator body 100 is disposed in the first actuator body 100 path first portion, the line of force 230 extends to a "first side" of the solenoid output shaft axis of rotation 65. As the rotary solenoid output shaft 64 and the shaft link 160 move/rotate from a first position to a second position and when the first actuator body 100 is disposed in the first actuator body 100 path second portion, the line of force 230 extends to a "second side" of the solenoid output shaft axis of rotation 65. In this configuration, the counter, or feedback, forces applied by the linkage assembly 150 on the first actuator body 100 are initially low (when compared to the higher forces, discussed below) when the first actuator body 100 is disposed in the first actuator body 100 path first portion. As the first actuator body 100 moves into the first actuator body 100 path second portion, the counter, or feedback, forces applied by the linkage assembly 150 on the first actuator body 100 increase until the line of force 230 passes over the solenoid output shaft axis of rotation 65. After the line of force 230 passes over the solenoid output shaft axis of rotation 65, the counter, or feedback, forces applied by the linkage assembly 150 on the first actuator body 100 rapidly decrease to nothing or a negligible amount. Thus, the combination of the linkage assembly 150 and the cam assembly 200 produce a feedback, or response, similar to a toggle. A specific example of the counter, or feedback, forces is shown below.

Figure 11:
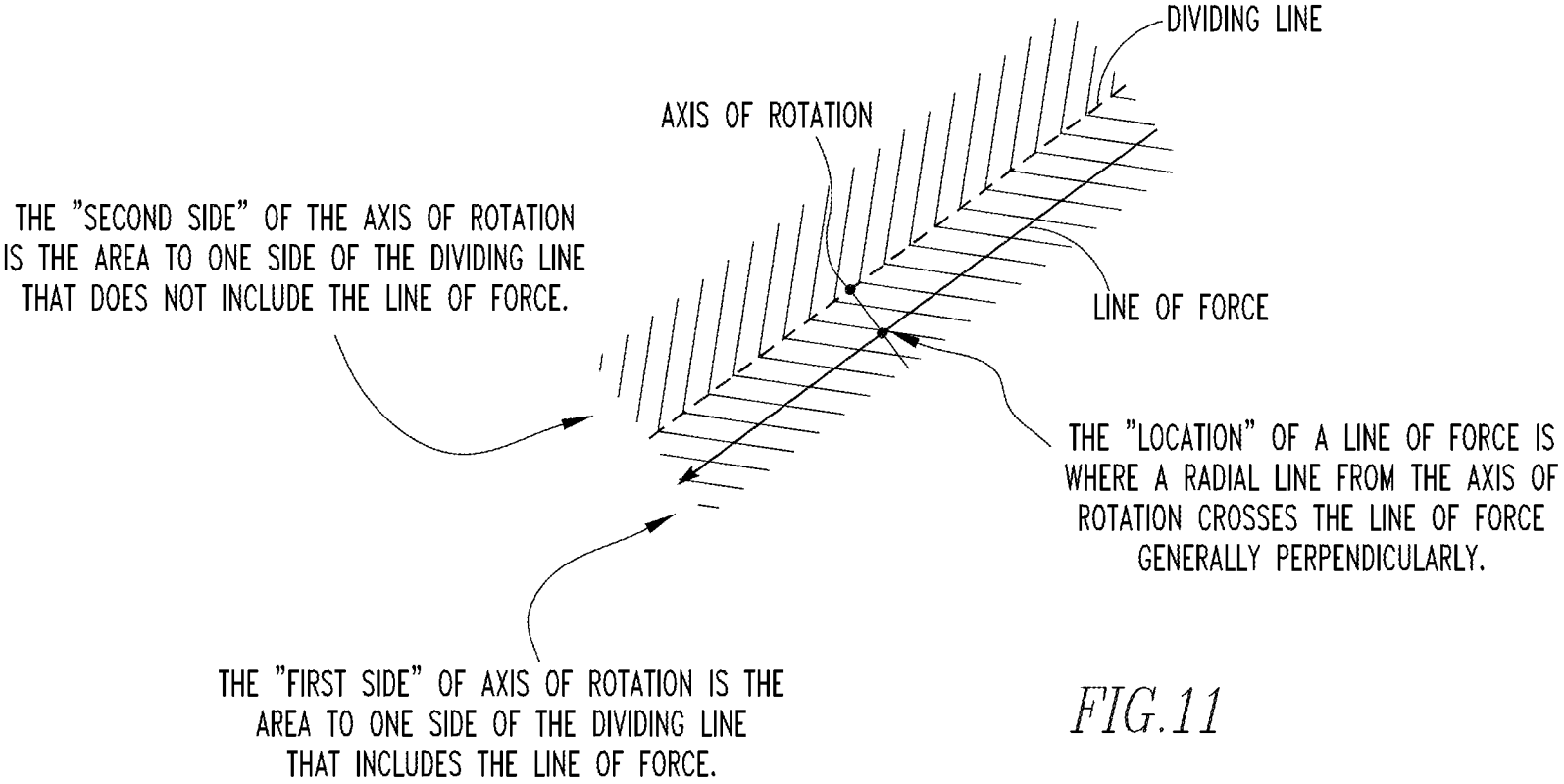
FIG. 11 is an illustration demonstrating the defined terms "first side" and "second side" of an axis of rotation and the "location" of a line of force relative to the axis of rotation.

Before discussing the specific example of counter, or feedback, forces, the "first side" and "second side" of the solenoid output shaft axis of rotation 65 are defined as follows. As used herein, the "sides" of an axis of rotation upon which a line of force is disposed are determined as follows. As shown in FIG. 11, the "sides" are determined while viewed along the axis of rotation. That is, as shown, the axis of rotation is represented as a point in FIG. 11 because the image is shown "along the axis of rotation." Further, all lines of force, and any other lines discussed herein, are limited to a two-dimensional representation of such a line as seen when viewed "along the axis of rotation," i.e., as shown in FIG. 11. That is, all lines are limited to the plane as shown in FIG. 11, which is a view along the axis of rotation. The "sides" of the axis of rotation are determined when the line of force does not pass through the axis of rotation and when the movable contact is in either the first position or second positon. That is, the "sides" of the axis of rotation relative to the closing actuator assembly 52 are determined when the movable contact 20 is in the first position, and, the "sides" of the axis of rotation relative to the opening actuator assembly 54 are determined when the movable contact 20 is in the second position. To identify the "sides" of the axis of rotation, a "dividing line" that is parallel to the initial location and direction of the line of force and which passes through the axis of rotation is identified. It is understood that the "initial location and direction of the line of force" for the closing actuator assembly 52 means the location and direction of the line of force when the closing operation begins. Conversely, the "initial location and direction of the line of force" for the opening actuator assembly 54 means the location and direction of the line of force when the opening operation begins. The side of the "dividing line" that initially includes the line of force is the "first side" of the axis of rotation. The opposite side of the "dividing line" is the "second side" of the axis of rotation. That is, the side of the "dividing line" without the initial line of force is the "second side" of the axis of rotation. Further, the location of a "line" (other than the "dividing line" or any other line that passes through the axis of rotation) is determined at a location that is "radial" to the axis of rotation and wherein the radial line intersects the other line generally perpendicularly. That is, a radial line from the axis of rotation extends to, and generally perpendicular to, the line of force. The location where the radial line intersects the line of force determines which side of the "dividing line," i.e., which side of the axis of rotation, the line of force is located. That is, as used herein, the "location" of a line of force relative to an axis of rotation is identified at the intersection of a radial line from the axis of rotation which is generally perpendicular to the line of force. Further, if the intersection of a radial line from the axis of rotation and the line of force is located on the "dividing line," then the line of force is, as used herein, located on the "first side" of the axis of rotation.

With these definitions in mind, and as shown in FIGS. 6-10, during the use of the closing actuator assembly 52, the first actuator 94 is in its first position and the line of force 230 is disposed on the first side of the solenoid output shaft axis of rotation 65. As a user actuates the first actuator 94 (which in this example is the actuator associated with the closing actuator assembly 52), the linkage assembly 150 causes the line of force 230 to move. That is, the motion of the first actuator 94 cause the linkage assembly 150 elements to move. The motion of the linkage assembly 150 causes the location of the line of force 230 to move.

As the first actuator 94 moves over the first actuator body 100 path first portion, the line of force 230 remains on the first side of the solenoid output shaft axis of rotation 65. Further, force applied to the first actuator body medial portion user interface, i.e., button 103, is relatively low compared to a latter force applied as discussed below. Similarly, the force the linkage assembly 150 applies to the rotary solenoid output shaft 64 is relatively low compared to latter forces applied to the rotary solenoid output shaft 64. Further, and in an exemplary embodiment, as the first actuator 94 moves over the first actuator body 100 path first portion, the motion of the linkage assembly 150 has a negligible effect on the crossbar 30. That is, in an exemplary embodiment wherein the middle link body first end opening 185 is an elongated slot 185A, the initial motion of the first actuator 94 is not transferred to the crossbar 30 via the linkage assembly 150 because the motion of shaft link 160 is not transferred to middle link 180 until the pin coupling links 160, 180 move to the end of elongated slot 185A. Further, it is noted that when the pin coupling links 160, 180 move to the end of elongated slot 185A, the first actuator body 100, and as shown rotating extension assembly 110, is operatively coupled to, and operatively engages, both the shaft link 160 and the middle link 180.

As the user continues to press the first actuator 94, the counter forces generated by the multi-level feedback actuator assembly 50 continue to increase. That is, as the first actuator 94 moves into, and over, the first actuator body 100 path second portion, the counter forces increase and are noticeably different from the counter forces generated by the multi-level feedback actuator assembly 50 when the first actuator body 100 is in the first actuator body 100 path first portion. Further, the motion of the linkage assembly 150 starts to noticeably effect the crossbar 30. That is, the crossbar 30 rotates and moves the movable contact 20 toward the second position. As shown in the chart below, the feedback forces generated on the first actuator 94 by the linkage assembly 150 are greatest as the crossbar 30 rotates and moves the movable contact 20 toward the second position. Just before the movable contact 20 engages the fixed contact 22, the feedback forces generated on the first actuator 94 by the linkage assembly 150 begin to reduce. When the movable contact 20 engages the fixed contact 22, the feedback forces generated on the first actuator 94 by the linkage assembly 150 are reduced by a noticeably different amount. Moreover, as the first actuator 94 moves into, and over, the first actuator body 100 path second portion, the line of force 230 remains on the first side of the solenoid output shaft axis of rotation 65. As the movable contact 20 engages the fixed contact 22, the line of force 230 crosses over to the second side of the solenoid output shaft axis of rotation 65. The configuration of the linkage assembly 150 as the line of force 230 crosses over the solenoid output shaft axis of rotation 65 is identified herein as the "toggle." Thus, as shown in the chart below, when the linkage assembly 150 passes over the toggle configuration, the feedback forces generated on the first actuator 94 by the linkage assembly 150 are reduced by an amount that is noticeably different when compared to the feedback forces generated on the first actuator 94 by the linkage assembly 150 when the line of force 230 is on the first side of the solenoid output shaft axis of rotation 65. Moreover, as the line of force 230 crosses over the solenoid output shaft axis of rotation 65, the movable contact 20 rapidly moves from the first position to the second position. That is, the movable contact 20 snaps closed. The rapid motion of the movable contact 20 from the first position to the second position reduces the chance of an arc being created and/or reduces the duration of an arc if an arc is created. At this point, the first actuator body 100 has moved into a third portion of the first actuator body 100 path of travel. Moreover, at this point in the actuation process, the movable contact 20 has moved into the second position. That is, the contacts 20, 22 are closed.

In an exemplary embodiment, the multi-level feedback actuator assembly 50 has the characteristics shown in the following chart.

| button degrees closed | lbs Force to press button (10) | description | The solenoid has 2 in/lb min in/lbs torque needed by solenoid to close (2 in/lbs) |
|---|---|---|---|
| 0.00 | 0.72 | Breaker open | 0.00 |
| 0.50 | 1.69 | Close button spring only | 0.32 |
| 1.00 | 1.59 | Switch activation | 0.28 |
| 1.50 | 1.94 | | 0.39 |
| 2.00 | 2.75 | | 0.65 |
| 2.28 | 4.55 | No movement of crossbar only solenoid rotation up to this point | 1.23 |
| 2.50 | 5.86 | Before contact touch | 1.59 |
| 3.00 | 3.75 | Before contact touch | 0.88 |
| 3.40 | 3.52 | Contact touch | 0.77 |

-continued

| button degrees closed | lbs Force to press button (10) | description | The solenoid has 2 in/lb min in/lbs torque needed by solenoid to close (2 in/lbs) |
|---|---|---|---|
| 3.50 | 3.20 | Opening spring cam near toggle point | 0.68 |
| 4.07 | 0.83 | At toggle | 0.00 |
| 4.50 | 0.83 | Closed | 0.00 |
| 5.00 | 0.83 | Breaker closed and over toggle | 0.00 |

Thus, in general, as a user begins to actuate the first actuator body medial portion user interface, i.e., button 103, there is initially a minimal feedback as the first actuator body 100 moves over the null portion of the path (if the null portion exists due to elongated slot 185A as noted above) as well as the first actuator body 100 path first portion. During this time, the linkage assembly 150 applies a first bias to the first actuator body 100 which is detectable by the user. As the first actuator body 100 moves over the first actuator body 100 path first portion, the first actuator body 100 actuates the first switch assembly 72. That is, the first actuator body 100 actuates the first switch assembly actuator 76. When the first switch assembly 72 is actuated, and if the first switch assembly 72 is able to apply a charge to the rotary solenoid 60, the first switch assembly 72 actuates the rotary solenoid 60 causing the movable contact 20 to move into the second position and generating a noticeable feedback. If the user detects the noticeable feedback, the user is informed that the movable contact 20 is in the second position and the user stops actuating the first actuator 94. Further, the rotating extension assembly return spring 116 returns the first actuator 94 to its first position.

If, however, the first switch assembly 72 is not able to apply a charge to the rotary solenoid 60, the first switch assembly 72 does not actuate the rotary solenoid 60 and there is no noticeable feedback. Thus, the user is informed that further actuation of the first actuator 94 is required. As such, the user continues to press the first actuator body medial portion user interface, i.e., button 103, causing the first actuator body 100 to move over the first actuator body 100 path second portion. As detailed above, the linkage assembly 150 generates an increasing second bias that is applied to the first actuator body 100 and which is detectable to the user. As noted above, the second bias is greater than the first bias and the first bias is noticeably different from the second bias. Further, as also noted above, continued motion of the first actuator body 100 over the first actuator body 100 path second portion manually moves the movable contact 20 into the second position. When the movable contact 20 moves into the second position, the feedback force generated by the linkage assembly 150 which is applied to the first actuator body 100 decreases by an amount that is noticeably different from the second bias. Thus, by virtue of the change in the feedback force, the user is informed that the movable contact 20 has been moved into the second position. The user stops actuating the first actuator 94 and the rotating extension assembly return spring 116 returns the first actuator 94 to its first position. Thus, the multi-level feedback closing actuator assembly 52 is structured to, and does, move the movable contact 20 from the first position to the second position while providing different tactile feedback, i.e., feedback forces that are detectable by the user via the button 103.

In an embodiment of the multi-level feedback actuator 50 that includes both a closing actuator assembly 52 and an opening actuator assembly 54, the opening actuator assembly 54 includes a second actuator 96 as discussed above. The following description will use the term "second actuator" 94 but, it is understood that in an embodiment with only an opening actuator assembly 54, this actuator would be identified as the "first" actuator.

In this embodiment, and in addition to the elements described above, the multi-level feedback actuator 50 includes the second actuator 96, mentioned above, as well as a second switch assembly 1072. The second actuator 96 includes an elongated body 1100 having a first end 1102, a medial portion 1104, and a second end 1106. As shown, the second actuator body 1100 is an assembly including bodies 1100A and 1100B, but is, as used herein, identified as a single element. Further, while shown as having an elongated axle 1109, discussed below, the second actuator body 1100 is, as used herein, "elongated" in the same direction as the first actuator body 100 as discussed above. Thus, the second actuator body 1100 rotates in a plane that is generally parallel to the plane of rotation of the first actuator body 100 as discussed above.

The second actuator body first end 1102 is structured to be, and is, rotatably coupled to the circuit breaker housing assembly 12. In an exemplary embodiment, the second actuator body first end 1102 includes a rotational coupling 1108 such as, but not limited to, an axle 1109 that is structured to be, and is, coupled to the circuit breaker housing assembly 12. That is, in an exemplary embodiment, the circuit breaker housing assembly 12 includes a circular passage (not numbered) that corresponds to the second actuator body second end axle 1109. It is noted that in this configuration, the second actuator body 1100 moves, i.e., rotates, generally in a single plane. That is, the longitudinal axis of the second actuator body 1100 moves, i.e., rotates, generally in a plane which extends generally perpendicular to the second actuator body first end rotational coupling 1108 axis of rotation. The second actuator body medial portion 1104 defines a user interface such as, but not limited to, a button 1103. In an exemplary embodiment, the second actuator body medial portion 1104 also includes a switch assembly interface 1107 which is shown as an extension 1105 that extends generally opposite the button 1103. The second actuator body second end 1106 is structured to be, and is, operatively coupled to the linkage assembly 150. Thus, the second actuator body second end 1106 is structured to, and does, operatively engage the linkage assembly 150. That is, second actuator body 1100 is operatively coupled to the linkage assembly 150 and is structured to, and does, move at least one link 160, 170, 180, 190.

The second actuator 96, i.e., the multi-level feedback actuator assembly 50, further includes a number of return springs 1101. The multi-level feedback actuator assembly return springs 1101 are disposed between the second actuator body 1100 and the circuit breaker housing assembly 12. The multi-level feedback actuator assembly return springs 1101 are structured to, and do, bias the second actuator body 1100 to a first position.

The second switch assembly 1072 is substantially similar to the first switch assembly 72 and, as such, will not be described in detail. It is noted that, as identified in the figures, the elements of the second switch assembly 1072 have the same reference numbers+1000. Thus, the second switch assembly 1072 includes a housing assembly 1074 and an actuator 1076, i.e., a lever/button combination (neither shown). As is known, the second switch assembly conductors (e.g., wires, not numbered) are coupled to, and are in electric communication with, the rotary solenoid coil. The second switch assembly 1072 is structured to, and does, provide a charge/current with characteristics that cause the rotary solenoid output shaft 64 to rotate in a direction that is opposite the direction the rotary solenoid output shaft 64 rotates when a charge/current is applied by the first switch assembly 72. Thus, when the second switch assembly 1072 is actuated, a charge/current is applied to the rotary solenoid coil and the rotary solenoid output shaft 64 moves between positions. That is, the second switch assembly 1072 is structured to, and does, hold a charge (or otherwise selectively allows a current to pass therethrough) that is sufficient to cause the rotary solenoid output shaft 64 to move between positions. The second switch assembly 1072 is coupled, directly coupled, or fixed to the circuit breaker housing assembly 12 in a position so that the second switch assembly actuator 1076 is disposed in the path of the second actuator body medial portion switch assembly interface 1107.

The linkage assembly 150 is substantially the same as the linkage assembly 150 described above with the following exception. For the opening actuator assembly 54, an edge surface of the shaft link body first end 164 is structured to be, and is, a second actuator interface 1169. In an exemplary embodiment, the shaft link body second end first actuator interface 1169, which is an edge surface, is disposed adjacent, or immediately adjacent, the cam assembly second cam member 204.

The second actuator body 1100 is structured to be, and is, rotatably coupled to the circuit breaker housing assembly 12 and moves between an unactuated, first position and an actuated, second position as well as over a path having at least a first portion and a second portion. As indicated by the names, when the second actuator body 1100 is unactuated, the second actuator body 1100 is in the first position. When the second actuator body 1100 is fully actuated, it is in the second position. As used herein, the second actuator body 1100 path "first portion" and "second portion" are those portions of the second actuator body 1100 path wherein the second actuator body 1100 operatively engages different sets of elements of the multi-level feedback actuator assembly 50. That is, as used herein, the second actuator body 1100 path "first portion" is that portion of the second actuator body 1100 path wherein the second actuator body 1100 operatively engages the second switch assembly 1072, i.e., the switch assembly actuator 1076. The second actuator body 1100 path "second portion" is that portion of the second actuator body 1100 path wherein the second actuator body 1100 operatively engages the linkage assembly 150 as well as the second switch assembly 1072. When the second actuator body 1100 is at the end of the second actuator body 1100 path "second portion," the second actuator body 1100 is in the second position. As with the first actuator body 100, the second actuator body 1100 moves over a "null" portion of the path in some embodiments, i.e., an embodiment wherein the middle link body first end opening 185 is an elongated slot 185A.

As before, the linkage assembly 150 is structured to, and does, apply at least a first bias to the second actuator body 1100 and a second bias to the second actuator body 1100. Further, the first bias is noticeably different from the second bias. That is, the linkage assembly 150 is structured to apply the first bias to the second actuator body 1100 when the second actuator body 1100 is disposed in the second actuator body 1100 path first portion, and, the linkage assembly 150 is structured to, and does, apply the second bias to the second actuator body 1100 when the second actuator body 1100 is disposed in the second actuator body 1100 path second portion.

Figure 12:
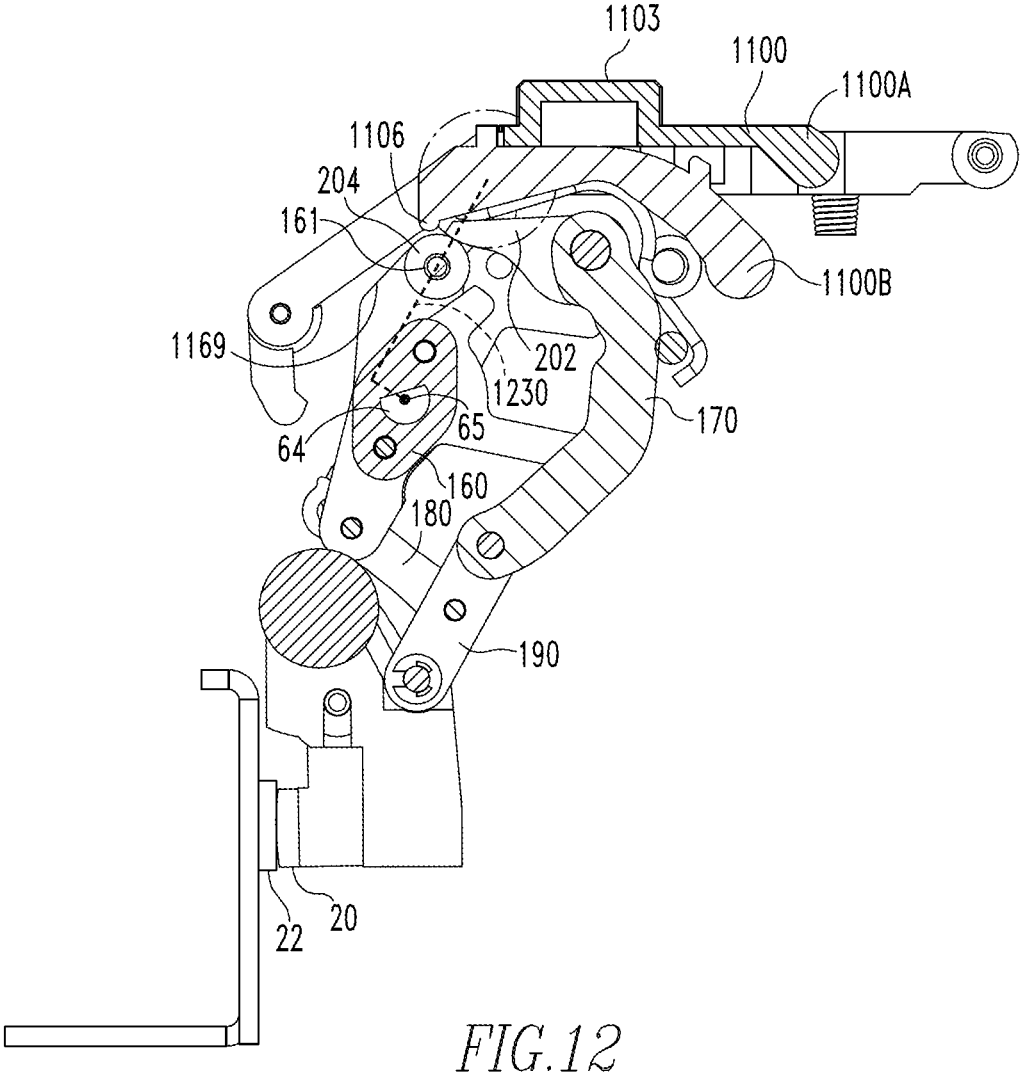
FIGS. 12-14 are partial sides views of a multi-level feedback opening actuator assembly with a limited number of elements identified.

For an opening actuator assembly 54, the multi-level feedback actuator assembly 50 operates as follows. Initially, it is noted that for the sake of this example using an opening actuator assembly 54, it is assumed that the movable contact 20 is in the closed, second position and the operating mechanism 16 is in the corresponding second configuration, i.e., the crossbar 30 is in a second position. Further, the second actuator body 1100 is in an unactuated, first position. In this configuration, the cam assembly bias device 206 creates a line of force 1230 extending from a point of contact between the cam assembly first cam member 202 and the second cam member 204 through shaft link body first end coupling 161. As shown in FIG. 12, the line of force 1230 is disposed on a "first" side of solenoid output shaft axis of rotation 65. It is noted that the "first" side of the solenoid output shaft axis of rotation 65 for the second actuator 96 is different from the "first" side associated with the first actuator 94, as described above. Further, in the initial, second position, the second actuator body second end 1106 is spaced from the linkage assembly 150.

As a user engages the second actuator body medial portion user interface, i.e., button 1103, the second actuator body 1100 rotates and moves over the second actuator body 1100 path first portion. As the second actuator body 1100 moves over the second actuator body 1100 path first portion, the second actuator body 1100, and as shown, the second actuator body medial portion switch assembly interface 1107 engages, and actuates, the second switch assembly actuator 1076. Thus, second actuator body 1100 is structured to, and does, operatively engage the second switch assembly actuator 1076 when the second actuator body 1100 is disposed in the second actuator body 1100 path first portion. As discussed above, following actuation of the second switch assembly actuator 1076, the rotary solenoid 60 is actuated and moves the rotary solenoid output shaft 64 from a second position to a first position. Rotation of the rotary solenoid output shaft 64 causes the linkage assembly 150 to move from a second configuration to a first configuration which, in turn, causes the crossbar 30 (and other elements of the operating mechanism 16) to move from a second position/configuration to a first position/configuration. As discussed above, when the operating mechanism 16 moves from a second configuration to a first configuration, the movable contact 20 moves from the second position to the first position. That is, the movable contact 20 opens.

This is the normal operation of the electric actuator assembly 70. That is, the electric actuator assembly 70 includes the second actuator 96, the rotary solenoid 60, and the second switch assembly 1072. Further, as discussed below, actuating the electric actuator assembly 70 requires minimal force on the second actuator 96. That is, the counter, or feedback, forces applied by the electric actuator assembly 70 are relatively low when compared to the feedback forces generated by the manual actuator assembly 80, as discussed below. Thus, there is a first bias applied to the second actuator 96 as the second actuator 96 moves over the second actuator body 1100 path first portion. Further, if the electric actuator assembly 70 actuates the rotary solenoid 60, there is a noticeable feedback, as described above. Thus, if a user detects the rotary solenoid 60 noticeable feedback, the user is informed that the electric actuator assembly 70 has moved the movable contact 20 from the second position to the first position and the user stops pressing on the second actuator body medial portion user interface, i.e., button 1103.

If the electric actuator assembly 70 is not able to move the movable contact 20 from the second position to the first position, e.g., if the second switch assembly 1072 is not able to provide a charge to the rotary solenoid 60, then the user must utilize the manual actuator assembly 80 to move the movable contact 20 from the second position to the first position. This is accomplished by continuing to press on the second actuator body medial portion user interface, i.e., button 1103.

That is, as the user continues to press on the second actuator body medial portion user interface, i.e., button 1103, the second actuator body 1100 moves into the second actuator body 1100 path second portion. As the second actuator body 1100 moves into the second actuator body 1100 path second portion, the second actuator body 1100 engages the linkage assembly 150. That is, the second actuator body second end 1106 engages the shaft link body first end second actuator interface 1169. This bias causes the shaft link 160 to rotate. Thus, the second actuator body 1100 is structured to, and does, operatively engage the linkage assembly 150 when the second actuator body 1100 is disposed in the second actuator body 1100 path second portion. As noted above, the shaft link 160 is operatively coupled to the rotary solenoid output shaft 64, thus, rotation of the shaft link 160 causes the rotary solenoid output shaft 64 to rotate from a second position to a first position and generates a noticeable feedback. Further, as described above, rotation of the rotary solenoid output shaft 64 causes the operating mechanism 16, and therefore the movable contact 20, to move into their first positions/configurations.

In general, the linkage assembly 150 provides a counter, or feedback, bias/force to the second actuator body 1100. In an exemplary embodiment, the bias the linkage assembly 150 provides to the second actuator body 1100 while the second actuator body 1100 is in the second actuator body 1100 path first portion is less than the bias the linkage assembly 150 provides to the second actuator body 1100 while the second actuator body 1100 is in the second actuator body 1100 path second portion. This is accomplished, at least in part, by the forces generated in the cam assembly 200.

That is, as noted above, the cam assembly bias device 206 creates a line of force 1230 extending from a point of contact between the cam assembly first cam member 202 and the second cam member 204 through shaft link body first end coupling 161. Initially, i.e., when the second actuator body 1100 is disposed in the second actuator body 1100 path first portion, the line of force 1230 extends to a "first side" of the solenoid output shaft axis of rotation 65. As the rotary solenoid output shaft 64 and the shaft link 160 move/rotate from a second position to a first position and when the second actuator body 1100 is disposed in the second actuator body 1100 path second portion, the line of force 1230 extends to a "second side" of the solenoid output shaft axis of rotation 65. In this configuration, the counter, or feedback, forces applied by the linkage assembly 150 on the second actuator body 1100 are initially low (when compared to the higher forces, discussed below) when the second actuator body 1100 is disposed in the second actuator body 1100 path first portion. As the second actuator body 1100 moves into the second actuator body 1100 path second portion, the counter, or feedback, forces applied by the linkage assembly 150 on the second actuator body 1100 increase until the line of force 1230 passes over the solenoid output shaft axis of rotation 65. After the line of force 1230 passes over the solenoid output shaft axis of rotation 65, the counter, or feedback, forces applied by the linkage assembly 150 on the second actuator body 1100 rapidly decrease to nothing or a negligible amount. Thus, the combination of the linkage assembly 150 and the cam assembly 200 produce a feedback, or response, similar to a toggle. A specific example of the counter, or feedback, forces is shown below.

Figure 13:
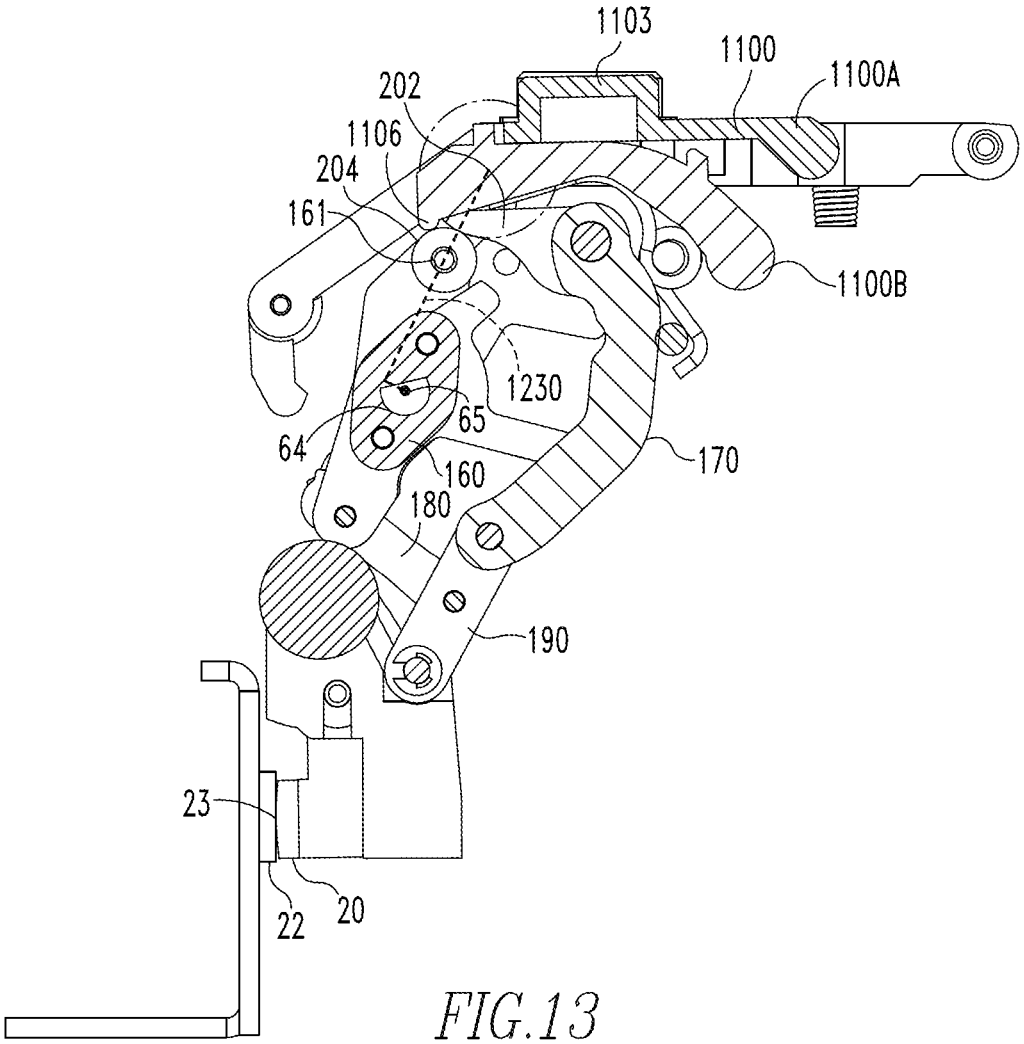
Figure 14:
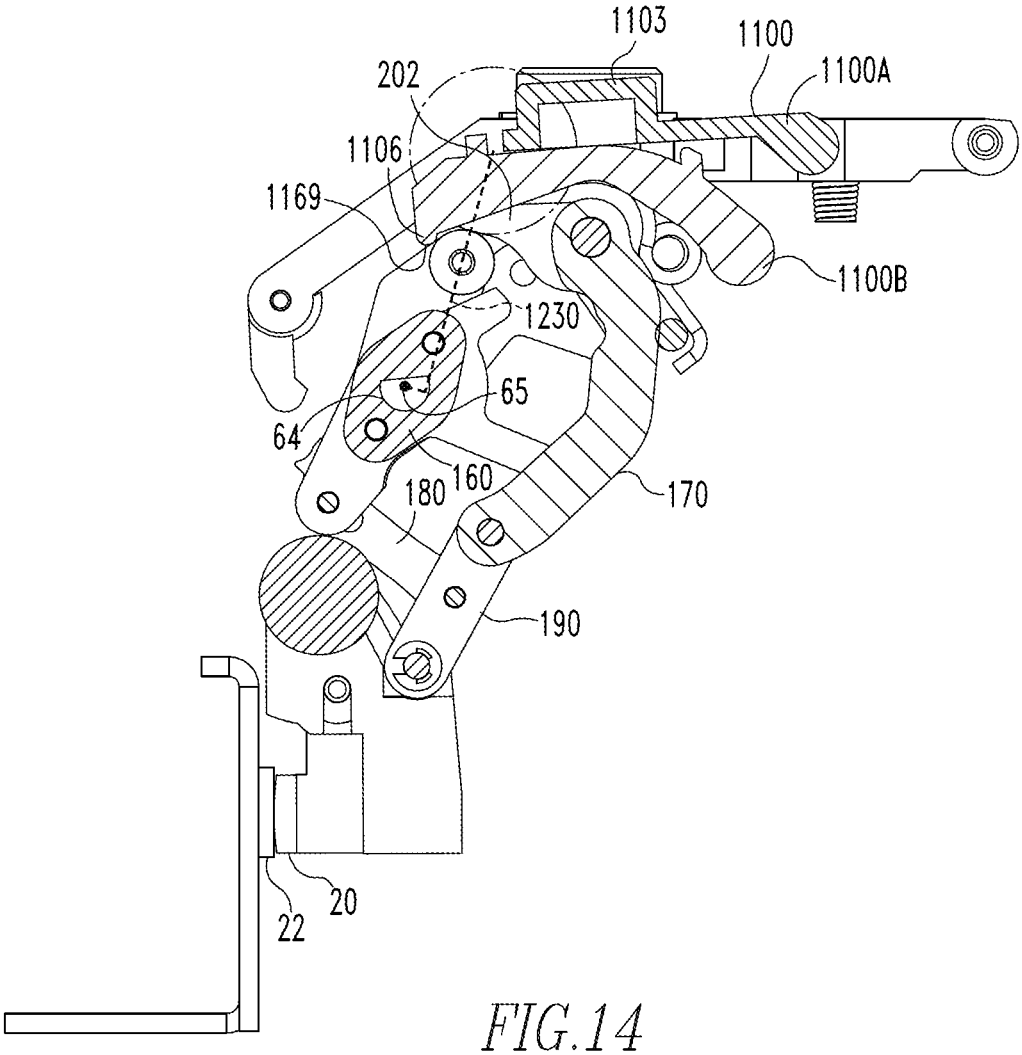

That is, as shown in FIGS. 12-14, during the use of the opening actuator assembly 54, the second actuator 96 is in its first position and the line of force 1230 is disposed on the first side of the solenoid output shaft axis of rotation 65 (FIG. 12). As a user actuates the second actuator 96 (which in this example is the actuator associated with the opening actuator assembly 54), the linkage assembly 150 causes the line of force 1230 to move. That is, the motion of the opening actuator assembly 54 cause the linkage assembly 150 elements to move. The motion of the linkage assembly 150 causes the location of the line of force 1230 to move.

As the second actuator 96 moves over the second actuator body 1100 path first portion, the line of force 1230 remains on the first side of the solenoid output shaft axis of rotation 65. Further, force applied to the first actuator body medial portion user interface, i.e., button 103, is relatively low compared to a latter force applied as discussed below. Similarly, the force the linkage assembly 150 applies to the rotary solenoid output shaft 64 is relatively low compared to latter forces applied to the rotary solenoid output shaft 64. As the second actuator 96 moves over the second actuator body 1100 path first portion, the motion of the linkage assembly 150 has a negligible effect on the crossbar 30. That is, in an exemplary embodiment wherein the middle link body first end opening 185 is an elongated slot 185A, the initial motion of the second actuator 96 is not transferred to the crossbar 30 via the linkage assembly 150 because the motion of shaft link 160 is not transferred to middle link 180 until the pin coupling links 160, 180 moves to the end of elongated slot 185A.

As the user continues to press the second actuator 96, the counter forces generated by the multi-level feedback actuator assembly 50 continue to increase. That is, as the second actuator 96 moves into, and over, the second actuator body 1100 path second portion, the counter forces increase and are noticeably different from the counter forces generated by the multi-level feedback actuator assembly 50 when the second actuator body 1100 is in the second actuator body 1100 path first portion. Further, the motion of the linkage assembly 150 starts to noticeably effect the crossbar 30. That is, when the crossbar 30 rotates and moves the movable contact 20 toward the first position, the feedback forces generated on the second actuator 96 by the linkage assembly 150 are almost double the feedback forces generated on the second actuator 96 when the second actuator body 1100 is in the second actuator body 1100 path first portion.

Moreover, as the second actuator 96 moves into, and over, the second actuator body 1100 path second portion, the line of force 1230 remains on the first side of the solenoid output shaft axis of rotation 65. As the crossbar starts to move the movable contact 20, the line of force 1230 crosses over to the second side of the solenoid output shaft axis of rotation 65. The configuration of the linkage assembly 150 as the line of force 1230 crosses over the solenoid output shaft axis of rotation 65 is identified herein as the "toggle." Thus, as shown in the chart below, when the linkage assembly 150 passes over the toggle configuration, the feedback forces generated on the second actuator 96 by the linkage assembly 150 are noticeably different when compared to the feedback forces generated on the second actuator 96 by the linkage assembly 150 when the line of force 1230 is on the first side of the solenoid output shaft axis of rotation 65. At this point in the actuation process, the movable contact has moved into the first position. That is, the contacts 20, 22 are open.

Further, the opening actuator assembly 54, in an exemplary embodiment, includes a "force leveling assembly" 1300. As used herein, a "force leveling assembly" is a construct that is structured to change a characteristic of one actuator assembly to substantially resemble a similar characteristic of another actuator assembly. With the closing actuator assembly 52 and the opening actuator assembly 54 configured as described above, the biases, i.e., both the first and second bias, associated with the closing actuator assembly 52 are different than the biases, i.e., both the first and second bias, associated with the opening actuator assembly 54. As noted above, however, users prefer complimentary actuators, e.g., open and close actuators, have substantially the same tactile feedback, i.e., the same biases. Further, and due to the geometry, position, and other aspects of the elements of the closing actuator assembly 52, the closing actuator assembly 52 biases are greater than the biases of the opening actuator assembly 54. Thus, the opening actuator assembly 54 includes a "force leveling assembly" 1300.

In an exemplary embodiment, the multi-level feedback actuator assembly return springs 1101 are structured to, and do, act as the force leveling assembly 1300. That is, the multi-level feedback actuator assembly return springs 1101 increase the biases on the second actuator body 1100. That is, the multi-level feedback actuator assembly return springs 1101 increase both the first bias applied to the second actuator body 1100 and the second bias applied to the second actuator body 1100 by the linkage assembly 150. Moreover, the multi-level feedback actuator assembly return springs 1101 are structured to increase the bias so that both the first bias and the second bias applied to the second actuator body 1100 by the linkage assembly 150 are substantially the same as the first bias and the second bias applied to the first actuator body 100 by the linkage assembly 150. In this configuration, the force leveling assembly 1300 solves the problem(s) noted above.

In an exemplary embodiment, the multi-level feedback actuator assembly 50 has the characteristics shown in the following chart.

| Open button degrees pressed | lbs of force to press the button | description | in/lbs torque needed by the solenoid to open (2 in/lbs) |
|---|---|---|---|
| 0 | 1.55 | Button not pressed and fully closed | 0.05 |
| 1.05 | 1.96 | Switch activated and solenoid trying to open from internal spring | 0.00 |
| 3.3 | 3.33 | Lever starting to move the crossbar | 0.20 |

Thus, in general, as a user begins to actuate the second actuator body medial portion user interface, i.e., button 1103, there is initially a minimal feedback as the second actuator body 1100 moves over the null portion of the path (if the null portion exists) as well as the second actuator body 1100 path first portion. During this time, the linkage assembly 150 applies a first bias to the second actuator body 1100 which is detectable by the user. As the second actuator body 1100 moves over the second actuator body 1100 path first portion, the second actuator body 1100 actuates the second switch assembly 1072. That is, the second actuator body 1100 actuates the second switch assembly actuator 1076. When the second switch assembly 1072 is actuated, and if the second switch assembly 1072 is able to apply a charge to the rotary solenoid 60, the second switch assembly 1072 actuates the rotary solenoid 60 causing the movable contact 20 to move into the first position and generating a noticeable feedback. If the user detects the noticeable feedback, the user is informed that the movable contact 20 is in the first position and the user stops actuating the second actuator 96.

If, however, the second switch assembly 1072 is not able to apply a charge to the rotary solenoid 60, the second switch assembly 1072 does not actuate the rotary solenoid 60 and there is no noticeable feedback. Thus, the user is informed that further actuation of the second actuator 96 is required. As such, the user continues to press the second actuator body medial portion user interface, i.e., button 1103, causing the second actuator body 1100 to move over the second actuator body 1100 path second portion. As detailed above, the linkage assembly 150 generates an increasing second bias that is applied to the second actuator body 1100 and which is detectable to the user. As noted above, the second bias is greater than the first bias and the first bias is noticeably different from the second bias. Further, as also noted above, continued motion of the second actuator body 1100 over the second actuator body 1100 path second portion manually moves the movable contact 20 into the first position. When the movable contact 20 moves into the first position, the feedback force generated by the linkage assembly 150 which is applied to the second actuator body 1100 decreases by an amount that is noticeably different from the second bias. Thus, by virtue of the change in the feedback force, the user is informed that the movable contact 20 has been moved into the first position. The user stops actuating the second actuator 96 and the multi-level feedback actuator assembly return springs 1101 returns the second actuator 96 to its first position. Thus, the multi-level feedback closing actuator assembly 52 is structured to, and does, move the movable contact 20 from the second position to the first position while providing different tactile feedback, i.e., feedback forces that are detectable by the user via the button 1103.

Further, in an exemplary embodiment, the opening actuator assembly 54 is structured to be an under voltage regulator. In this embodiment, the cam assembly 200, i.e., the cam assembly bias device 206 generates sufficient bias to move the rotary solenoid output shaft 64 from the second position to the first position. That is, the cam assembly 200 is structured to, and does, apply an opening bias to the operating mechanism crossbar 30 via the linkage assembly 150. When the rotary solenoid 60 is drawing the proportional current from the circuit breaker assembly 10 use current, the rotary solenoid 60 generates a bias that is sufficient to match or, in an exemplary embodiment, slightly overcome the bias generated by the cam assembly 200. That is, the cam assembly 200 opening bias is substantially equal to, or less than, the rotary solenoid 60 closing bias. In this configuration, the rotary solenoid 60 is structured to, and does, apply a closing bias to the operating mechanism crossbar 30 when drawing the proportional current from the circuit breaker assembly 10 use current. Thus, when the use current, and therefore the proportional current, falls below a selected minimum current, the rotary solenoid 60 closing bias is reduced and the cam assembly 200 is structured to, and does, operatively engage the operating mechanism crossbar 30 and moves the operating mechanism crossbar to the first position. This, in turn, causes the movable contact 20 to move to the open, first position. Thus, the opening actuator assembly 54 is structured to be an under voltage regulator.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A multi-level feedback actuator assembly for a circuit breaker assembly, said circuit breaker assembly structured to have a use current selectively passed therethrough, said circuit breaker assembly including a housing assembly, a separable contact assembly and an operating mechanism, said housing assembly defining a substantially enclosed space, said separable contact assembly including a number of fixed contacts and a number of movable contacts, each said movable contact movable between an open, first position, wherein each said movable contact is spaced from, and is not in electrical communication with, an associated fixed contact, and, a second position, wherein each said movable contact is coupled to, and is in electrical communication with, the associated fixed contact, said operating mechanism structured to move said number of movable contacts between said first and second positions, said operating mechanism including an elongated crossbar, said operating mechanism crossbar rotatably coupled to said housing assembly, said operating mechanism crossbar structured to move between a first position and a second position corresponding to said movable contacts first position and said movable contacts second position, said multi-level feedback actuator assembly comprising:

a rotary solenoid;

an electric actuator assembly including a switch assembly;

a manual actuator assembly including a linkage assembly and a number of primary actuators including a first actuator including a first actuator body;

said switch assembly operatively coupled to said rotary solenoid, wherein said switch assembly is structured to actuate said rotary solenoid;

said rotary solenoid operatively coupled to said linkage assembly;

said linkage assembly operatively coupled to rotary solenoid and said first actuator body; and said linkage assembly structured to be operatively coupled to said operating mechanism crossbar.

2. The multi-level feedback actuator assembly of claim 1 wherein:

said first actuator body is structured to move over a path having at least a first portion and a second portion;

said linkage assembly is structured to apply at least a first bias to said first actuator body and a second bias to said first actuator body;

said first bias is noticeably different from said second bias;

said linkage assembly is structured to apply said first bias to said first actuator body when said first actuator body is disposed in said first actuator body path first portion; and said linkage assembly is structured to apply said second bias to said first actuator body when said first actuator body is disposed in said first actuator body path second portion.

3. The multi-level feedback actuator assembly of claim 2 wherein:

switch assembly includes an actuator;

said first actuator body is structured to operatively engage said switch assembly actuator when said first actuator body is disposed in said first actuator body path first portion; and said first actuator body is structured to operatively engage said linkage assembly when said first actuator body is disposed in said first actuator body path second portion.

4. The multi-level feedback actuator assembly of claim 3 wherein:

said rotary solenoid includes a rotating output shaft;

said linkage assembly includes a number of links;

said manual actuator assembly including a cam assembly;

said cam assembly includes a first cam member, a second cam member and a bias device;

said first actuator body operatively coupled to said linkage assembly and structured to move at least one link;

said linkage assembly operatively coupled to said first actuator body, said rotary solenoid output shaft and said cam assembly;

said cam assembly operatively coupled to linkage assembly;

said cam assembly bias device structured to apply a bias to at least one of said first cam member or said second cam member; and wherein said cam assembly applies bias to said linkage assembly.

5. The multi-level feedback actuator assembly of claim 4 wherein:

said first actuator body is elongated and includes a first end, a medial portion, and a second end;

said first actuator body first end structured to be rotatably coupled to said circuit breaker housing assembly;

said first actuator body medial portion defining a button;

said first actuator body second end structured to be operatively coupled to said linkage assembly;

said linkage assembly including a shaft link;

said shaft link including an elongated body with a first end, a medial portion, and a second end;

each of said shaft link body first end, shaft link body medial portion and shaft link body second end including a coupling;

said shaft link body medial portion fixed and operatively coupled to said rotary solenoid output shaft;

wherein said shaft link body rotates with said solenoid output shaft;

said cam assembly second cam member coupled to said shaft link body first end;

said cam assembly first cam member disposed adjacent said shaft link body first end path of travel and structured to engage said cam assembly second cam member;

said cam assembly bias device structured to engage said cam assembly first cam member;

wherein said cam assembly bias device creates a line of force extending from a point of contact between said cam assembly first cam member through said shaft link body first end coupling;

wherein, when said first actuator body is disposed in said first actuator body path first portion, said line of force extends to a first side of said solenoid output shaft axis of rotation, and, when said first actuator body is disposed in said first actuator body path second portion, said line of force extends to a second side of said solenoid output shaft axis of rotation.

6. The multi-level feedback actuator assembly of claim 5 wherein:

said cam assembly first cam member includes an elongated body having a generally curvilinear cam surface;

said cam assembly second cam member includes a body having a generally circular cam surface;

said cam assembly second cam member rotatably coupled to said shaft link body first end; and wherein said cam assembly first cam member body cam surface engages said cam assembly second cam member body cam surface.

7. The multi-level feedback actuator assembly of claim 5 wherein:

said linkage assembly includes an upper link, a middle link, a lower link, and a shaft link;

said upper link including an elongated body with a first end and a second end;

said upper link body first end and said upper link body second end each including a coupling;

said middle link including an elongated body with a first end and a second end;

said middle link body first end and said middle link body second end each including a coupling;

said middle link including an elongated body with a first end and a second end;

said middle link body first end and said upper link body second end each including a coupling;

said lower link including an elongated body with a first end, a medial portion and a second end;

said lower link body first end, lower link body medial portion and said lower link body second end each including a coupling;

said cam assembly first cam member rotatably coupled to said upper link body first end;

said upper link body second end rotatably coupled to said lower link body first end;

said middle link body first end rotatably coupled to said shaft link body first end;

said middle link body second end rotatably coupled to said lower link body medial portion; and said lower link body second end structured to be rotatably coupled to said operating mechanism crossbar.

8. The multi-level feedback actuator assembly of claim 7 wherein said first actuator body second end is structured to operatively engage said shaft link body second end.

9. The multi-level feedback actuator assembly of claim 1 wherein said rotary solenoid is structured to provide a noticeable feedback when actuated.

10. The multi-level feedback actuator assembly of claim 1 wherein:

said rotary solenoid structured to draw a proportional current from the circuit breaker assembly use current;

said rotary solenoid structured to apply a closing bias to said operating mechanism crossbar when drawing the proportional current from the circuit breaker assembly use current;

said cam assembly structured to apply an opening bias to said operating mechanism crossbar;

wherein said cam assembly opening bias is substantially equal to said rotary solenoid closing bias; and wherein, when said proportional current falls below a selected minimum current, said rotary solenoid closing bias is reduced and said cam assembly is structured to operatively engage said operating mechanism crossbar and move said operating mechanism crossbar to said first position.

11. A circuit breaker assembly, said circuit breaker assembly structured to have a use current selectively passed therethrough, said circuit breaker assembly comprising:

a housing assembly;

a separable contact assembly;

an operating mechanism;

said housing assembly defining a substantially enclosed space;

said separable contact assembly including a number of fixed contacts and a number of movable contacts, each said movable contact movable between an open, first position, wherein each said movable contact is spaced from, and is not in electrical communication with, an associated fixed contact, and, a second position, wherein each said movable contact is coupled to, and is in electrical communication with, the associated fixed contact;

said separable contact assembly substantially disposed within said housing assembly enclosed space;

said operating mechanism structured to move said number of movable contacts between said first and second positions, said operating mechanism including an elongated crossbar;

said operating mechanism substantially disposed within said housing assembly enclosed space;

said operating mechanism crossbar rotatably coupled to said housing assembly, said operating mechanism crossbar structured to move between a first position and a second position corresponding to said movable contacts first position and said movable contacts second position;

a multi-level feedback actuator assembly including a rotary solenoid, an electric actuator assembly including a switch assembly, and a manual actuator assembly including a linkage assembly and a number of primary actuators including a first actuator including a first actuator body;

said switch assembly operatively coupled to said rotary solenoid, wherein said switch assembly is structured to actuate said rotary solenoid;

said rotary solenoid operatively coupled to said linkage assembly;

said linkage assembly operatively coupled to rotary solenoid and said first actuator body; and said linkage assembly structured to be operatively coupled to said operating mechanism crossbar.

12. The circuit breaker assembly of claim 11 wherein:

said rotary solenoid structured to draw a proportional current from the circuit breaker assembly use current;

said rotary solenoid structured to apply a closing bias to said operating mechanism crossbar when drawing the proportional current from the circuit breaker assembly use current;

said cam assembly structured to apply an opening bias to said operating mechanism crossbar;

wherein said cam assembly opening bias is substantially equal to said rotary solenoid closing bias; and wherein, when said proportional current falls below a selected minimum current, said rotary solenoid closing bias is reduced and said cam assembly is structured to operatively engage said operating mechanism crossbar and move said operating mechanism crossbar to said first position.

13. The circuit breaker assembly of claim 11 wherein:

said first actuator body is structured to move over a path having at least a first portion and a second portion;

said linkage assembly is structured to apply at least a first bias to said first actuator body and a second bias to said first actuator body;

said first bias is noticeably different from said second bias;

said linkage assembly is structured to apply said first bias to said first actuator body when said first actuator body is disposed in said first actuator body path first portion; and said linkage assembly is structured to apply said second bias to said first actuator body when said first actuator body is disposed in said first actuator body path second portion.

14. The circuit breaker assembly of claim 13 wherein said second bias is greater than said first bias.

15. The circuit breaker assembly of claim 13 wherein:

switch assembly includes an actuator;

said first actuator body is structured to operatively engage said switch assembly actuator when said first actuator body is disposed in said first actuator body path first portion; and said first actuator body is structured to operatively engage said linkage assembly when said first actuator body is disposed in said first actuator body path second portion.

16. The circuit breaker assembly of claim 15 wherein:

said linkage assembly includes a number of links;

said cam assembly includes a first cam member, a second cam member and a bias device;

said first actuator body operatively coupled to said linkage assembly and structured to move at least one link;

said linkage assembly operatively coupled to said first actuator body, said rotary solenoid output shaft and said cam assembly;

said cam assembly operatively coupled to linkage assembly;

said cam assembly bias device structured to apply a bias to at least one of said first cam member or said second cam member; and wherein said cam assembly applies bias to said linkage assembly.

17. The circuit breaker assembly of claim 16 wherein:

said first actuator body is elongated and includes a first end, a medial portion, and a second end;

said first actuator body first end structured to be rotatably coupled to said circuit breaker housing assembly;

said first actuator body medial portion defining a button;

said first actuator body second end structured to be operatively coupled to said linkage assembly;

said linkage assembly including a shaft link;

said shaft link including an elongated body with a first end, a medial portion, and a second end;

each of said shaft link body first end, shaft link body medial portion and shaft link body second end including a coupling;

said shaft link body medial portion fixed and operatively coupled to said rotary solenoid output shaft;

wherein said shaft link body rotates with said solenoid output shaft;

said cam assembly second cam member coupled to said shaft link body first end;

said cam assembly first cam member disposed adjacent said shaft link body first end path of travel and structured to engage said cam assembly second cam member;

said cam assembly bias device structured to engage said cam assembly first cam member;

wherein said cam assembly bias device creates a line of force extending from a point of contact between said cam assembly first cam member through said shaft link body first end coupling; and wherein, when said first actuator body is disposed in said first actuator body path first portion, said line of force extends to a first side of said solenoid output shaft axis of rotation, and, when said first actuator body is disposed in said first actuator body path second portion, said line of force extends to a second side of said solenoid output shaft axis of rotation.

18. The circuit breaker assembly of claim 17 wherein:

said cam assembly first cam member includes an elongated body having a generally curvilinear cam surface;

said cam assembly second cam member includes a body having a generally circular cam surface;

said cam assembly second cam member rotatably coupled to said shaft link body first end; and wherein said cam assembly first cam member body cam surface engages said cam assembly second cam member body cam surface.

19. The circuit breaker assembly of claim 17 wherein:

said linkage assembly includes an upper link, a middle link, a lower link, and a shaft link;

said upper link including an elongated body with a first end and a second end;

said upper link body first end and said upper link body second end each including a coupling;

said middle link including an elongated body with a first end and a second end;

said middle link body first end and said middle link body second end each including a coupling;

said lower link including an elongated body with a first end, a medial portion and a second end;

said lower link body first end, lower link body medial portion and said lower link body second end each including a coupling;

said cam assembly first cam member rotatably coupled to said upper link body first end;

said upper link body second end rotatably coupled to said lower link body first end;

said middle link body first end rotatably coupled to said shaft link body first end;

said middle link body second end rotatably coupled to said lower link body medial portion; and said lower link body second end structured to be rotatably coupled to said operating mechanism crossbar.

20. The circuit breaker assembly of claim 19 wherein said first actuator body second end is structured to operatively engage said shaft link body second end.

* * * * *